US009132567B2

(12) United States Patent
Shepard et al.

(10) Patent No.: US 9,132,567 B2
(45) Date of Patent: Sep. 15, 2015

(54) TOOLS WITH A THERMO-MECHANICALLY MODIFIED WORKING REGION AND METHODS OF FORMING SUCH TOOLS

(75) Inventors: Christon L. Shepard, Middletown, OH (US); Ronald R. LaParre, Centerville, OH (US); Shrinidhi Chandrasekharan, Dayton, OH (US); James M. Loffler, Tullahoma, TN (US); Alan L. Shaffer, Cincinnati, OH (US)

(73) Assignee: Dayton Progress Corporation, Dayton, OH (US)

( * ) Notice: Subject to any disclaimer, the term of this patent is extended or adjusted under 35 U.S.C. 154(b) by 534 days.

(21) Appl. No.: 12/047,532

(22) Filed: Mar. 13, 2008

(65) Prior Publication Data

US 2008/0229893 A1 Sep. 25, 2008

Related U.S. Application Data

(60) Provisional application No. 60/896,729, filed on Mar. 23, 2007.

(51) Int. Cl.
*B21K 5/02* (2006.01)
*B26F 1/14* (2006.01)
(Continued)

(52) U.S. Cl.
CPC . *B26F 1/14* (2013.01); *B21D 37/01* (2013.01); *B21D 37/20* (2013.01); *B21D 37/205* (2013.01); *B21J 5/08* (2013.01); *B21K 5/20* (2013.01); *B22F 3/162* (2013.01); *B22F 3/17* (2013.01); *C21D 6/02* (2013.01); *C21D 7/13* (2013.01); *C21D 9/0068* (2013.01); *C21D 9/18* (2013.01); *C22C 33/0278* (2013.01);
(Continued)

(58) Field of Classification Search
CPC ..... B26F 1/14; B21D 37/205; B21D 37/20; B21J 5/08; B21K 5/20; C21D 7/13; B22F 3/17; B22F 2005/002
USPC ..... 76/101.1; 29/557; 72/352–356
See application file for complete search history.

(56) References Cited

U.S. PATENT DOCUMENTS 229,840 A * 7/1880 Richards ..... 83/686
254,195 A 2/1882 Brown
(Continued)

FOREIGN PATENT DOCUMENTS

EP 0587489 A1 3/1994
EP 1657315 A1 5/2006
(Continued)

OTHER PUBLICATIONS

Fountaintown Forging, Why should I buy metal forging? [online]. [Retrieved on Jan. 10, 2014]. Retreived from the internet <URL:http://www.fountaintownforge.com/faq>.*
(Continued)

*Primary Examiner* — Kenneth E. Peterson
*Assistant Examiner* — Jennifer Swinney
(74) *Attorney, Agent, or Firm* — Wood, Herron & Evans, LLP

(57) ABSTRACT

Tools with a thermo-mechanically modified working region and methods of forming such tools. The tool includes a working region containing steel altered by a thermo-mechanical process to contain modified carbide and/or alloy bands. In use, a surface of the working region contacts a workpiece when the tool is used to perform a metal-forming operation.

29 Claims, 17 Drawing Sheets

(51) Int. Cl.

| | |
|---|---|
| ***B21D 37/01*** | (2006.01) |
| ***B21D 37/20*** | (2006.01) |
| ***B21J 5/08*** | (2006.01) |
| ***B21K 5/20*** | (2006.01) |
| ***B22F 3/16*** | (2006.01) |
| ***B22F 3/17*** | (2006.01) |
| ***C21D 6/02*** | (2006.01) |
| ***C21D 7/13*** | (2006.01) |
| ***C21D 9/00*** | (2006.01) |
| ***C21D 9/18*** | (2006.01) |
| ***C22C 33/02*** | (2006.01) |
| ***C22C 38/22*** | (2006.01) |
| ***C22C 38/24*** | (2006.01) |
| *B22F 5/00* | (2006.01) |
| *B26F 1/44* | (2006.01) |

(52) U.S. Cl.

CPC ..... *C22C 38/22* (2013.01); *C22C 38/24* (2013.01); *B22F 2003/175* (2013.01); *B22F 2005/002* (2013.01); *B26F 1/44* (2013.01); *B26F 2001/4436* (2013.01); *Y10T 83/9454* (2015.04)

(56) References Cited

U.S. PATENT DOCUMENTS

| | | | | | |
|---|---|---|---|---|---|
| 295,227 | A | * | 3/1884 | Briggs et al. | 83/688 |
| 770,238 | A | * | 9/1904 | Lovejoy | 83/686 |
| 1,366,026 | A | * | 1/1921 | Rydbeck | 384/492 |
| 1,446,879 | A | | 2/1923 | Coffey | |
| 1,533,263 | A | * | 4/1925 | Pritchard | 83/157 |
| 1,542,047 | A | | 6/1925 | Ferrari | |
| 1,554,336 | A | | 9/1925 | Lapotterie | |
| 1,637,111 | A | | 7/1927 | Honig | |
| 1,687,825 | A | | 10/1928 | Brassert | |
| 1,952,388 | A | | 3/1934 | Simons | |
| 1,977,845 | A | | 10/1934 | Emmons | |
| 2,040,957 | A | | 5/1936 | Sanders | |
| 2,638,019 | A | * | 5/1953 | Stellin | 72/324 |
| 2,656,739 | A | * | 10/1953 | Mansfield | 72/373 |
| 2,717,846 | A | | 9/1955 | Harvey | |
| 2,622,682 | A | | 7/1956 | Goetzel et al. | |
| 2,753,261 | A | | 7/1956 | Goetzel et al. | |
| 2,755,689 | A | | 7/1956 | Sundback | |
| 2,767,837 | A | | 10/1956 | Nachtman et al. | |
| 2,767,838 | A | | 10/1956 | Nachtman et al. | |
| 2,934,463 | A | | 4/1960 | Schmatz et al. | |
| 3,010,207 | A | * | 11/1961 | Barnes | 30/366 |
| 3,076,361 | A | | 2/1963 | Epstein et al. | |
| 3,143,026 | A | * | 8/1964 | Akerson | 83/686 |
| 3,238,540 | A | * | 3/1966 | Muenchinger | 470/63 |
| 3,279,049 | A | | 10/1966 | Ellis et al. | |
| 3,290,936 | A | | 12/1966 | Harvey | |
| 3,340,102 | A | | 9/1967 | Kulin et al. | |
| 3,396,567 | A | * | 8/1968 | Bachmann | 72/318 |
| 3,413,166 | A | | 11/1968 | Zackay et al. | |
| 3,425,877 | A | | 2/1969 | Deacon et al. | |
| 3,535,910 | A | | 10/1970 | Connolly | |
| 3,650,163 | A | | 3/1972 | Juffs | |
| 3,737,981 | A | | 6/1973 | Plockinger et al. | |
| 3,752,709 | A | | 8/1973 | Zackay et al. | |
| 3,848,453 | A | | 11/1974 | Hardt | |
| 3,877,281 | A | | 4/1975 | Shimizu et al. | |
| 3,889,510 | A | | 6/1975 | Yamakoshi et al. | |
| 3,903,761 | A | * | 9/1975 | Runton | 76/119 |
| 3,903,784 | A | * | 9/1975 | Dekker | 411/399 |
| 3,923,469 | A | * | 12/1975 | Palynchuk | 428/611 |
| 3,964,938 | A | | 6/1976 | Tolliver et al. | |
| 3,974,728 | A | | 8/1976 | Herlan | |
| 3,983,042 | A | * | 9/1976 | Jain et al. | 508/121 |
| 4,015,657 | A | | 4/1977 | Petrov et al. | |
| 4,040,872 | A | | 8/1977 | Mudiare | |
| 4,077,812 | A | | 3/1978 | Tani | |
| 4,095,449 | A | | 6/1978 | Roach et al. | |
| 4,105,443 | A | | 8/1978 | Dearnaley et al. | |
| 4,170,497 | A | | 10/1979 | Thomas et al. | |
| 4,198,884 | A | | 4/1980 | Nakagawa et al. | |
| 4,222,260 | A | | 9/1980 | McDermott | |
| 4,249,945 | A | | 2/1981 | Haswell et al. | |
| 4,259,126 | A | | 3/1981 | Cole et al. | |
| 4,270,378 | A | | 6/1981 | Brown et al. | |
| 4,318,733 | A | * | 3/1982 | Ray et al. | 420/101 |
| 4,368,634 | A | | 1/1983 | Brown et al. | |
| 4,526,077 | A | * | 7/1985 | DeGuvera | 83/686 |
| 4,571,983 | A | | 2/1986 | Sanborn et al. | |
| 4,587,095 | A | | 5/1986 | Yoshimura et al. | |
| 4,608,851 | A | | 9/1986 | Khare | |
| 4,628,178 | A | | 12/1986 | Miyake et al. | |
| 4,644,776 | A | | 2/1987 | Berchem | |
| 4,729,872 | A | | 3/1988 | Kishida et al. | |
| 4,748,088 | A | | 5/1988 | Billgren | |
| 4,793,231 | A | | 12/1988 | Brown | |
| 4,830,930 | A | | 5/1989 | Taniguchi et al. | |
| 4,832,764 | A | | 5/1989 | Merz | |
| 4,838,062 | A | * | 6/1989 | Prenn | 72/41 |
| 4,878,403 | A | | 11/1989 | Barr | |
| 4,996,863 | A | | 3/1991 | Keeler | |
| 5,054,308 | A | | 10/1991 | Asai et al. | |
| 5,080,727 | A | | 1/1992 | Aihara et al. | |
| 5,094,698 | A | | 3/1992 | Gallagher, Jr. | |
| 5,110,379 | A | | 5/1992 | Finkl | |
| 5,136,905 | A | | 8/1992 | Stack et al. | |
| 5,345,129 | A | | 9/1994 | Molnar | |
| 5,406,825 | A | | 4/1995 | Horie et al. | |
| 5,511,450 | A | | 4/1996 | Nagao | |
| 5,577,323 | A | * | 11/1996 | Sawai et al. | 29/898.066 |
| 5,660,648 | A | | 8/1997 | Takada et al. | |
| 5,762,725 | A | | 6/1998 | Pichard et al. | |
| 5,820,706 | A | | 10/1998 | Bellus et al. | |
| 5,958,158 | A | | 9/1999 | Kron et al. | |
| 5,989,731 | A | | 11/1999 | Arisawa et al. | |
| 6,284,366 | B1 | | 9/2001 | Konig et al. | |
| 6,348,112 | B1 | | 2/2002 | Hildreth et al. | |
| 6,355,119 | B1 | | 3/2002 | Peters et al. | |
| 6,364,974 | B1 | | 4/2002 | Kobasko | |
| 6,419,770 | B1 | | 7/2002 | Miyashita et al. | |
| 6,454,991 | B1 | | 9/2002 | Yoshimura et al. | |
| 6,478,900 | B1 | | 11/2002 | Isogawa et al. | |
| 6,725,756 | B2 | | 4/2004 | Brenneke | |
| 6,743,311 | B2 | | 6/2004 | Nishigori et al. | |
| 6,811,899 | B2 | | 11/2004 | Inoue | |
| 6,838,048 | B2 | | 1/2005 | Nishi et al. | |
| 6,874,234 | B1 | | 4/2005 | Bauman et al. | |
| 7,093,526 | B2 | | 8/2006 | Ando et al. | |
| 7,150,897 | B2 | | 12/2006 | Mikus | |
| 7,162,907 | B2 | | 1/2007 | Joseph et al. | |
| 7,169,347 | B2 | | 1/2007 | Kuwabara et al. | |
| 7,462,853 | B2 | * | 12/2008 | Funakoshi et al. | 250/506.1 |
| 2004/0200552 | A1 | | 10/2004 | Fukumoto et al. | |
| 2005/0227772 | A1 | | 10/2005 | Kletecka et al. | |
| 2006/0075871 | A1 | | 4/2006 | Lockhart et al. | |
| 2006/0157163 | A1 | | 7/2006 | Shimizu et al. | |
| 2006/0231167 | A1 | | 10/2006 | Hillstrom | |
| 2007/0179515 | A1 | * | 8/2007 | Matsutani et al. | 606/167 |
| 2008/0308194 | A1 | | 12/2008 | Corquillet et al. | |

FOREIGN PATENT DOCUMENTS

| | | | | | |
|---|---|---|---|---|---|
| EP | 1985390 | A1 | | 10/2008 | |
| GB | 848594 | A | | 9/1960 | |
| JP | 56151125 | A | * | 11/1981 | B21D 28/34 |
| JP | 08300092 | | | 11/1996 | |
| JP | 11254077 | | | 9/1999 | |
| JP | 11256271 | | | 9/1999 | |
| JP | 2000015379 | | | 1/2000 | |
| JP | 2005314756 | A | | 11/2005 | |
| JP | 2007160318 | A | * | 6/2007 | |

OTHER PUBLICATIONS

Porter Precision Products, http://www.porterpunch.com/home.html, printed Feb. 1, 2007 (2 pages).

(56) References Cited

OTHER PUBLICATIONS

Ramanthan, et al., "Effect of prior microstructure on austenite decomposition and associated distortion" Aug. 2001, retrieved from http://www.forging.org/FIERF/pdf/Microstructure.pdf on Jun. 20, 2009.
International Search Report issued in corresponding PCT Application serial No. PCT/US2009/33887 dated Jun. 30, 2009.
International Searching Authority, International Search Report issued in corresponding PCT Application serial No. PCT/US2008/057338 dated Jun. 25, 2008, 2 pages.
Devor, et al., "Microstructure-Level Model for the Prediction of Tool Failure in WC-Co Cutting Tool Materials", Journal of Manufacturing Science and Engineering, Aug. 2006, vol. 128, Issue 3, Abstract, 1 page.
Hughes, et al., "Scaling of Misorientation Angle Distributions", Physical Review Letters, vol. 81, No. 21, Nov. 23, 1998.
Wert, et al., "Revealing Deformation Microstructures", materialstoday, Sep. 2007, vol. 10, No. 9.
European Search Report issued in corresponding European Application serial No. 09002103.1 dated Jul. 6, 2009.
EP 0587489—English translation.
JP 56 151125—English translation.
Dieter, George, "Mechanical Metallurgy", Jun. 1986, Title, Copyright, Table of Contents, pp. 524-539, McGraw-Hill, New York, U.S.
European Patent Office, International Search Report issued in corresponding European patent application No. 08251055.3 dated Sep. 26, 2008.
U.S. Patent and Trademark Office, Office Action in U.S. Appl. No. 12/370,906 dated Dec. 21, 2011.
European Patent Office, European Search Report issued in corresponding European patent application No. 11 16 5001 dated Jul. 15, 2011.
Japanese Patent Office, Office Action in JP2009-031600, mailed Jul. 23, 2013.
Mexican Patent Office, Office Action in Mexican Patent Application No. MX/a/20091001768, dated Sep. 5, 2013, including an English-language summary (5 pages).
Dieter, George E., "Fundamentals of Metalworking," Mechanical Metallurgy SI Metric Edition, Part 4, Chapter 15, p. 503, 1986 (5 pages).
ASM International, "Powder Metallurgy High-Speed Tool Steels," ASM Specialty Handbook, Tool Materials, 1995, p. 1 (4 pages).
Taiwan Patent Office, Office Action in (ROC) Taiwan Patent Application No. 097110451 dated Nov. 7, 2013.
Mexico Patent Office, Office Action in Mexican Patent Application No. MX/a/2009/001768, dated Oct. 28, 2014.
USPTO, Notice of Allowance issued in U.S. Appl. No. 12/370,906 dated Nov. 21, 2014.
USPTO, final Office Action issued in U.S. Appl. No. 12/370,906 dated Jul. 18, 2012.
USPTO, Office Action issued in U.S. Appl. No. 12/370,906 dated May 22, 2014.

* cited by examiner

TOOLS WITH A THERMO-MECHANICALLY MODIFIED WORKING REGION AND METHODS OF FORMING SUCH TOOLS

CROSS-REFERENCE TO RELATED APPLICATIONS

This application claims the benefit of U.S. Provisional Application No. 60/896,729, filed Mar. 23, 2007, which is hereby incorporated by reference herein in its entirety.

FIELD OF THE INVENTION

The invention relates to tools used in metal-forming and powder compaction applications and methods of forming such tools.

BACKGROUND OF THE INVENTION

Various types of tools are used in metal-forming applications such as machining, metal cutting, powder compaction, metal engraving, pin stamping, component assembling, and the like. In particular, punches and dies represent types of metal forming tools used to pierce, perforate, and shape metallic and non-metallic workpieces. Cutting tools and inserts represent types of metal forming tools used in machining applications to shape metallic and non-metallic workpieces. Punches and dies are subjected to severe and repeated loading during their operational life. In particular, punches tend to fail during use from catastrophic breakage induced by the significant stresses at the working end of the tool or other mechanisms, such as wear. The demands on metal-forming tools will become more severe with the introduction of workpieces constructed from steels having higher strength to weight ratios, such as ultra-high strength steels (UHSS's), advanced high-strength steels (AHSS's), transformation induced plasticity (TRIP) steels, and martensitic (MART) steels.

Punches are commonly constructed from various grades of tool steel. Conventional tool steels contain metal carbides that develop from a reaction of carbon with alloying metals, such as chromium, vanadium, and tungsten, found in common steel formulations. The metal carbide particles are initially present in bulk tool steel as clumps or aggregates. The carbide morphology, i.e. particle size and distribution, impacts the tool steel's material and mechanical properties, such as fracture toughness, impact resistance and wear resistance. These material and mechanical properties determine the ability of the tool steel to withstand the service conditions encountered by punches and dies in metalworking operations and serve as a guide in material selection for a particular application.

During tool steel manufacture, tool steel ingots or billets are typically hot worked above recrystallization temperature by hot rolling or forging process. When the tool steel is hot worked, segregated metal carbides may align substantially in the direction of work to form what is commonly known as carbide banding. Hot working of tool steel may also align regions enriched in certain segregated alloy components substantially in the direction of work to form what is commonly known as elemental or alloy banding.

The tendency of segregated metal carbides and alloy components to align along the working direction of hot rolled tool steel (i.e., in the rolling direction) in parallel, linear bands is illustrated in the optical micrographs of FIGS. 1 and 1B and a Scanning Electron Microscopy (SEM) micrograph of FIG. 1A. Collectively, the micrographs show images of polished and etched regions of a commercially available M2 tool steel grade bar stock in the hot rolled condition. At a microscopic level, the carbide and alloy bands have a prominent appearance as apparent from FIGS. 1, 1A, and 1B. In particular, the lighter bands visible in FIG. 1A represent higher alloy contents by weight percent and darker bands represent lower alloy contents by weight percent. In the particular case of S7 tool steel grade shown in FIG. 1A, the higher alloy content lighter bands contain 4.18 wt. % Cr and 2.16 wt % Mo while the lower alloy darker bands contain 3.38 wt. % Cr and 1.30 wt. % Mo. FIG. 1B is an optical micrograph of the banding in as-rolled commercial AISI M2 steel following heat treatment and triple tempering. The specimen was cut and polished and then etched with a 3% nital solution. Measurements of interband spacing, that is, measurements from mid-band on one band to mid-band on an adjacent band, indicate an average of approximately 135 μm with a standard deviation of the average of approximately 21 μm. FIG. 2 is an optical micrograph of a powder metallurgical M4 tool steel grade bar stock, which exhibits similar alignment of the metal carbide and alloy bands substantially along the rolling direction as apparent in FIG. 1A.

After hot rolling, the tool steel is fashioned into a blank that preserves the carbide and/or alloy banding. The directionality of the metal carbides in the carbide bands and the segregated alloy components in the alloy bands increases the probability of brittle fracture and wear along that direction. When tool steel blanks are machined to make tools, like punches and dies, the carbide and alloy bands tend to coincide with the primary loading direction along which fracture may occur during subsequent use.

What is needed, therefore, is a tool with a working region formed from steel that does not contain directional carbide and/or alloy bands.

SUMMARY OF THE INVENTION

In one embodiment, a tool is provided for use in a machine to shape a workpiece. The tool comprises an elongate steel member including a longitudinal axis, a shank configured to be coupled with the machine, and a tip spaced along the longitudinal axis from the shank. The tip includes a working surface adapted to contact the workpiece. The tip includes a first region proximate to the working surface in which the steel has a microstructure containing carbide and/or alloy bands that are not substantially aligned with the longitudinal axis.

In one embodiment, the tip of the elongate member includes a second region juxtaposed with one first region where the second region includes another plurality of carbide bands or another plurality of alloy bands that are substantially aligned with the longitudinal axis. In yet another embodiment, the carbide bands or alloy bands in the first region have an interband spacing that is less than a second interband spacing of the carbide bands or alloy bands in the second region. The carbide or alloy bands are more tightly compressed in the first region compared to the second. In another embodiment, a method is provided that comprises fabricating a steel preform having a shank and a tip arranged along a longitudinal axis. The tip of the preform is thermo-mechanically processed to define a region containing a microstructure with carbide and/or alloy bands that are not substantially aligned with the longitudinal axis of the tip. The method further comprises finishing the preform into a tool with the region of the tip defining a working surface of the tool.

The steel in the elongate member or preform may comprise a tool steel commonly used to form tools for machining, metal cutting, powder compaction, metal engraving, pin stamping, and metal-forming applications. In various embodiments, the tool steel may have a carbide content ranging from about 5 percent to about 40 percent by weight.

The steel of the preform is mechanically processed at an elevated temperature by a thermo-mechanical treatment or process, such as conventional forging processes. Suitable conventional forging processes include, but are not limited to, ring rolling, swaging, rotary forging, radial forging, hot and warm upsetting, and combinations of these forging processes. Thermo-mechanical treatment generally involves the simultaneous application of heat and a deformation process to an alloy, in order to change its shape and refine the microstructure. The thermo-mechanical process economically improves the resultant mechanical properties, such as impact resistance, fracture toughness, and wear resistance, of the steel. The modified mechanical properties are achieved without altering the metallurgical composition of the steel.

BRIEF DESCRIPTION OF THE DRAWINGS

The accompanying drawings, which are incorporated in and constitute a part of this specification, illustrate embodiments of the invention and, together with a general description of the invention given above and the detailed description of the embodiments given below, serve to explain the principles of the embodiments of the invention.

FIB. 5C is a perspective view of one embodiment of a tool, following thermo-mechanically processing of a preform with subsequent machining.

Figure 6A:
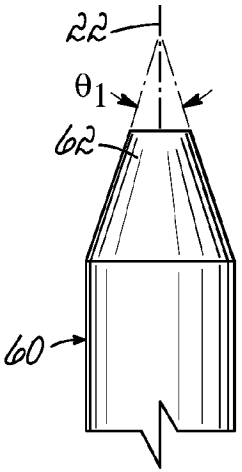
Figure 6B:
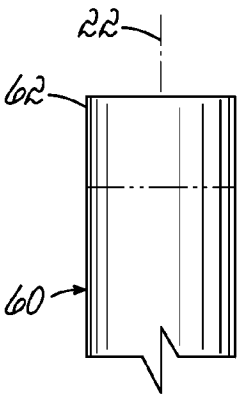

FIGS. 6A and 6B show a representative sequence of operations for thermo-mechanically processing a hot-rolled steel blank by hot-upsetting in accordance with an embodiment of the invention.

Figure 4A:
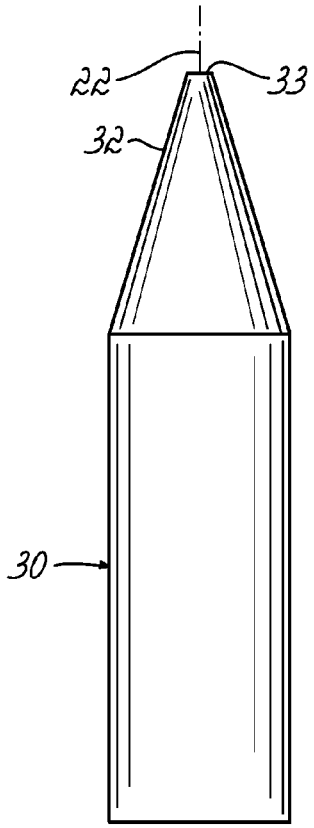
FIGS. 4A and 4B are side views of preforms or blanks that can be used to fabricate the tool of FIG. 3.
Figure 6C:
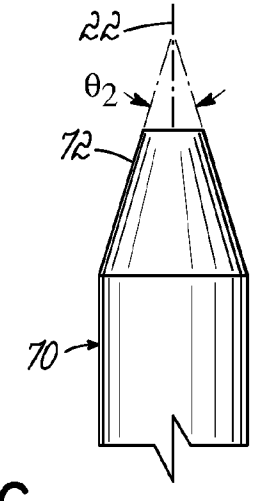
Figure 6D:
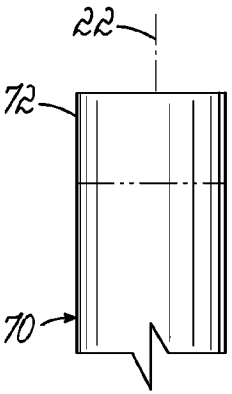

FIGS. 6C and 6D show other tool embodiments following thermo-mechanically processing a hot-rolled steel blank of FIG. 4A by forging and hot-upsetting in accordance with an alternative embodiment of the invention.

Figure 7:
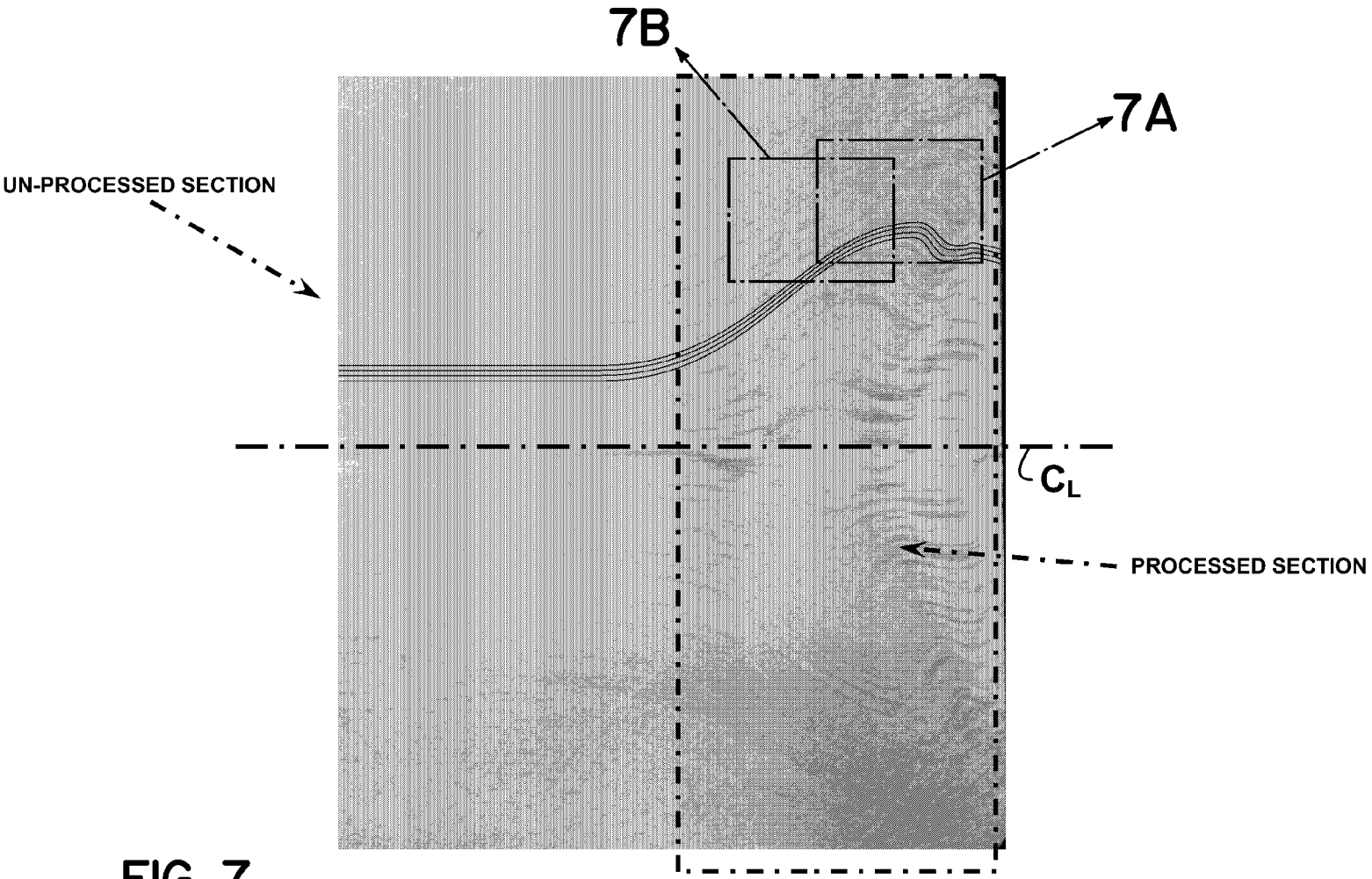

FIG. 7 is an optical micrograph of an M2 grade tool steel preform that has been modified by a thermo-mechanical process in accordance with one aspect of the invention and that, in the processed section, exhibits carbide and/or alloy banding that is not substantially aligned in the rolling direction.

Figure 7A:
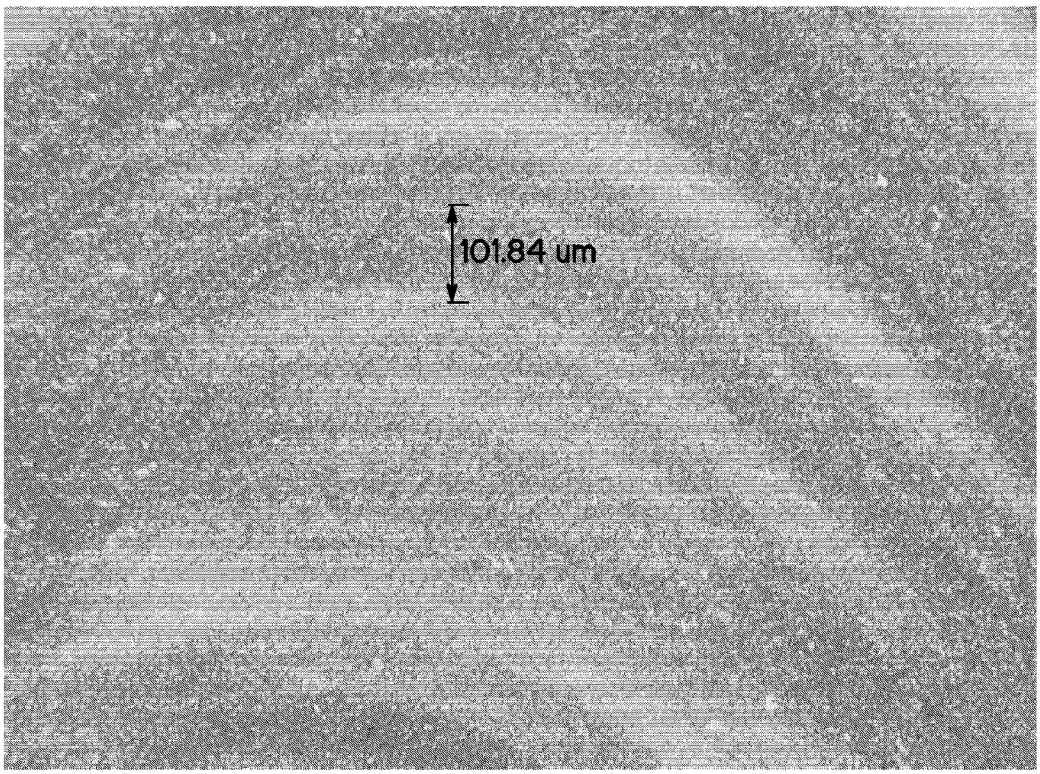

FIG. 7A is an optical micrograph taken of an area 7A of a specimen prepared similar to that shown in FIG. 7 taken at a magnification of about 100× showing a polished and etched region with carbide and/or alloy banding.

Figure 7B:
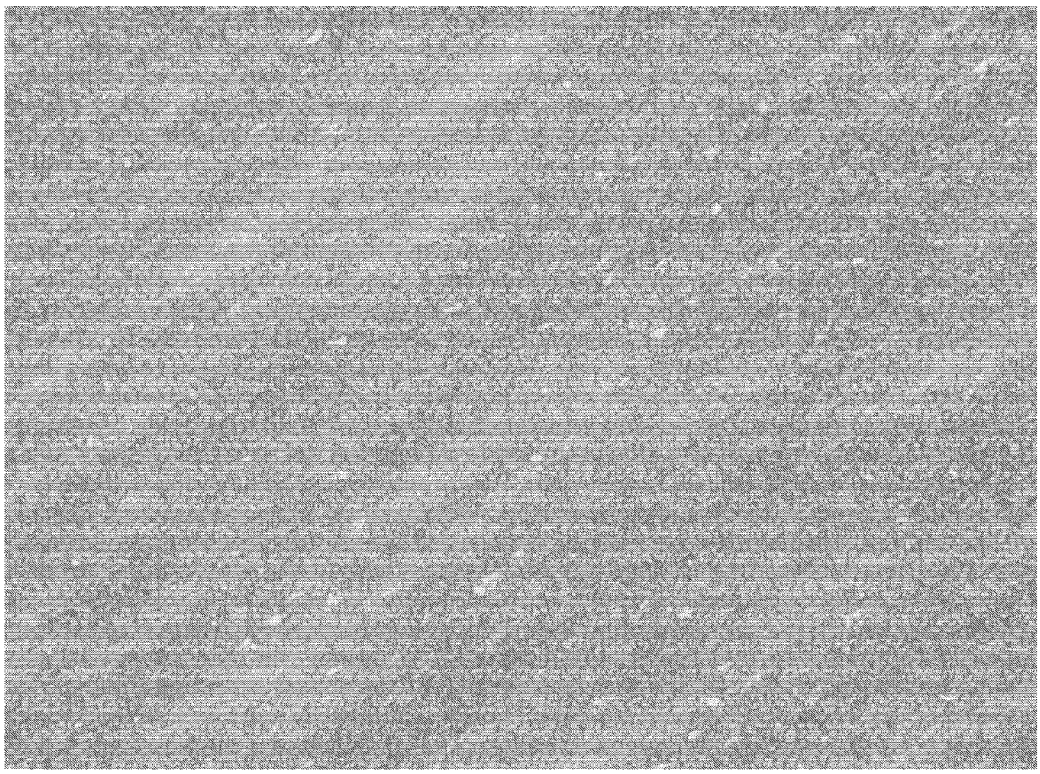

FIG. 7B is an optical micrograph taken of an area 7B of a specimen prepared similar to that shown in FIG. 7 taken at a magnification of about 100× showing a polished and etched region with carbide and/or alloy banding.

Figure 8:
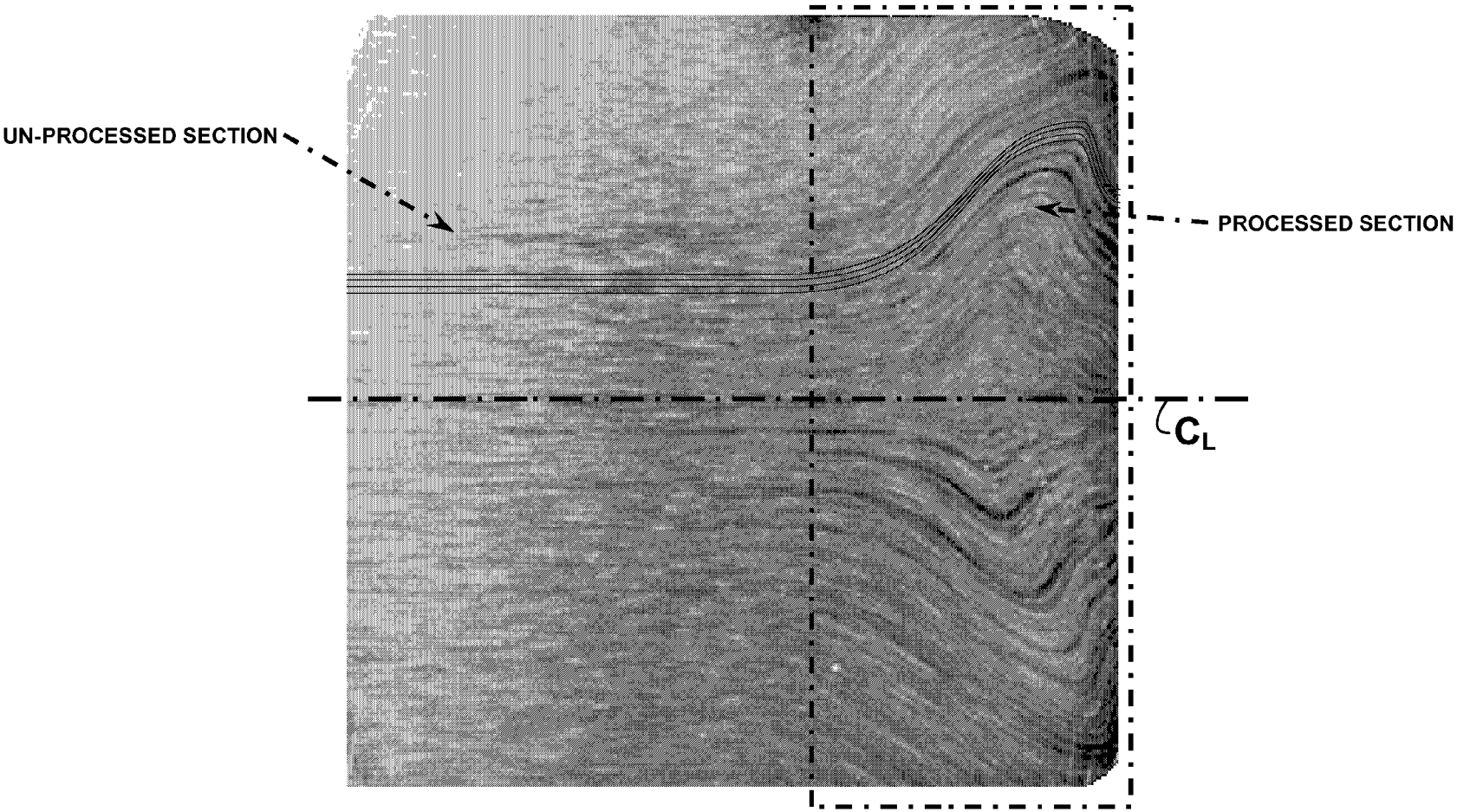

FIG. 8 is an optical micrograph of an as-rolled M2 grade tool steel preform after being subjected to two, discrete, hot-upsetting thermo-mechanical processes in accordance with an embodiment of the invention.

Figure 9:
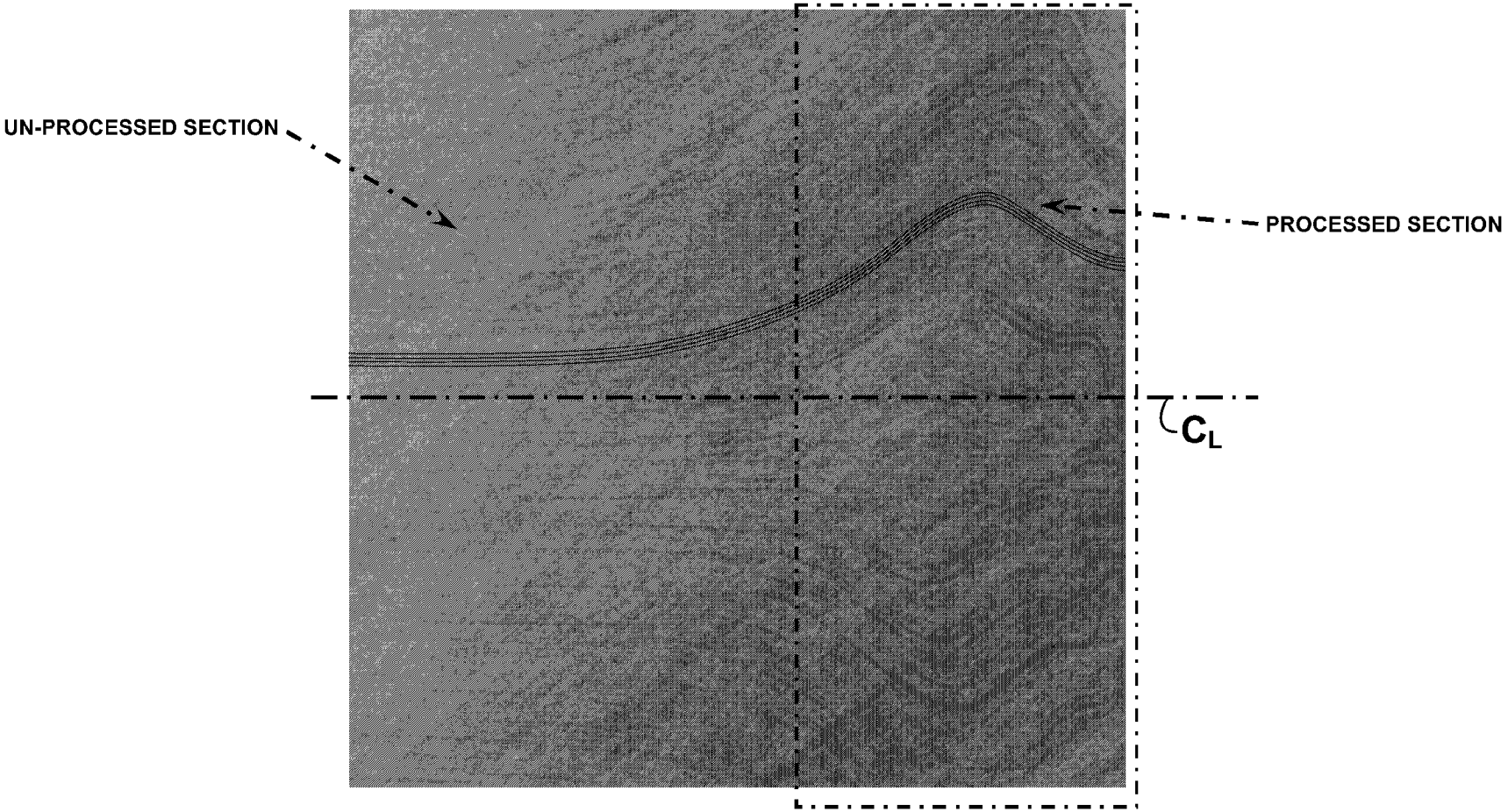

FIG. 9 is an optical micrograph of a powder metallurgical M4-grade tool steel grade preform after thermo-mechanical processing using a single hot-upsetting process in accordance with an embodiment of the invention.

Figure 10A:
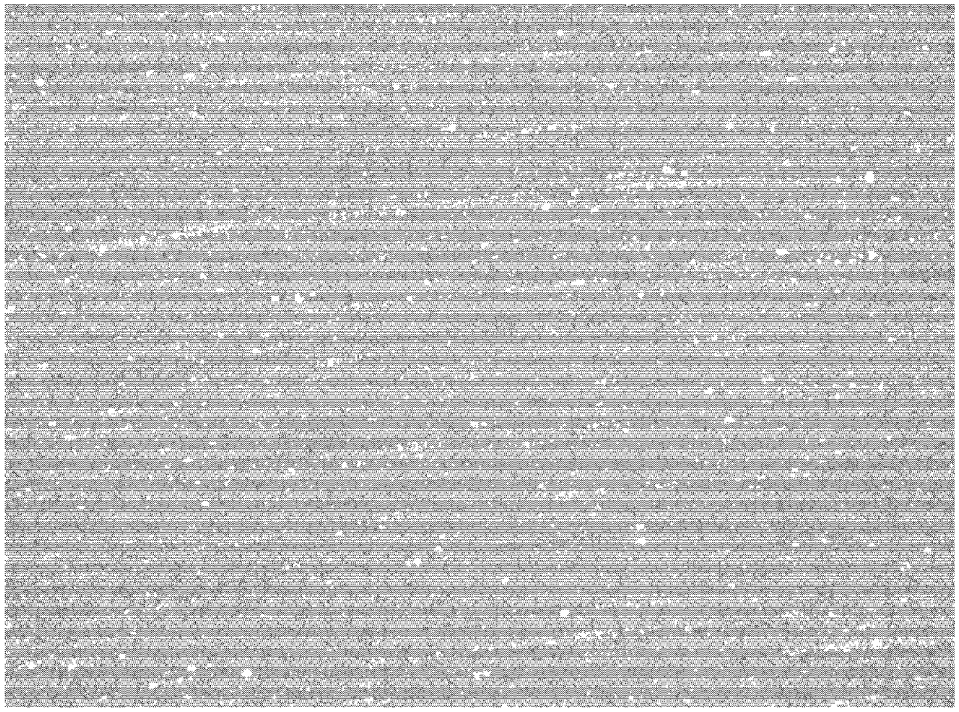
PRIOR ART FIG. 10A
Figure 10:
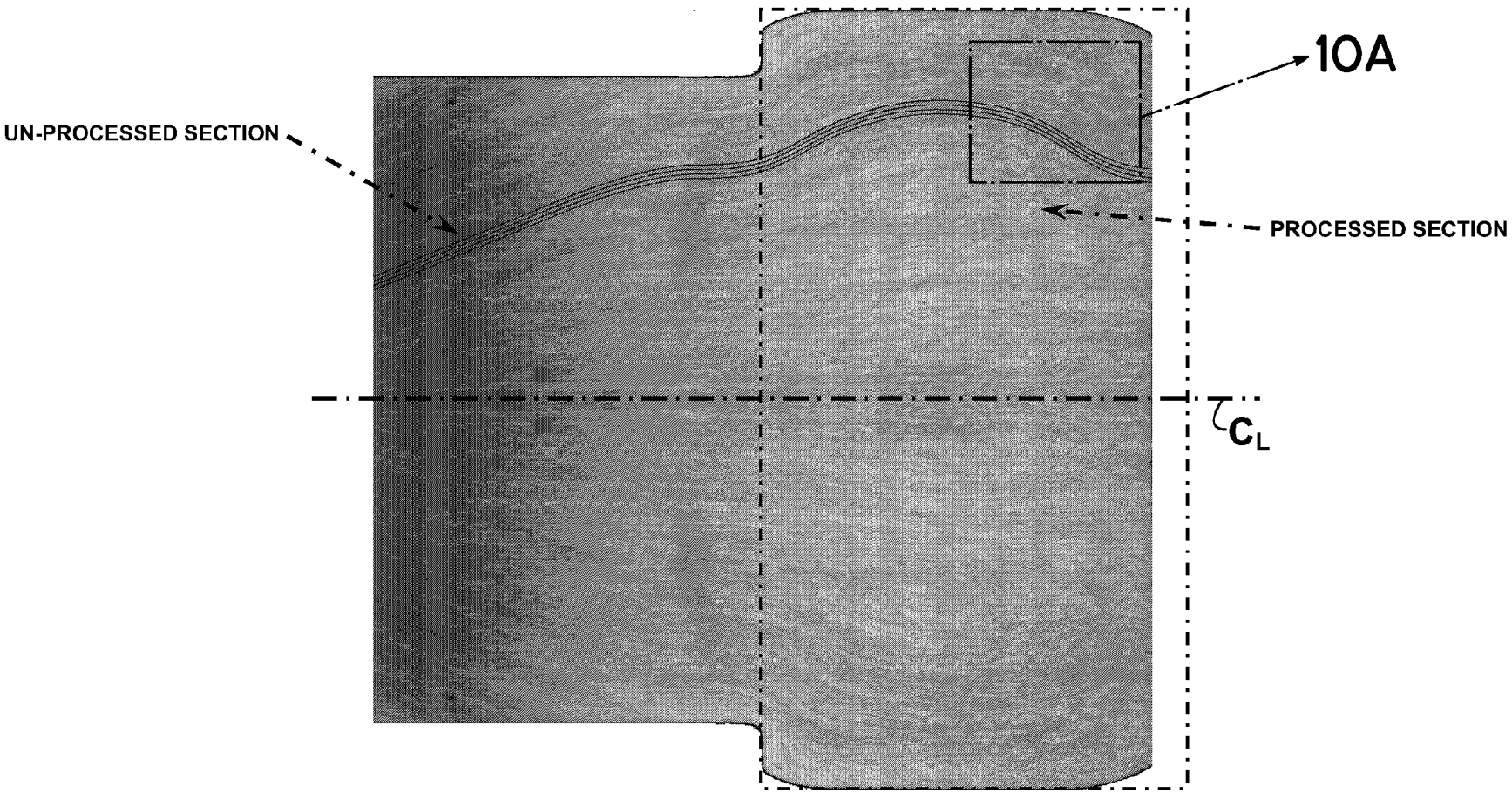
FIG. 10 PRIOR ART

FIG. 10 is an optical micrograph of a typical as-rolled bar stock specimen after a head-forging process to define a head for a tool in accordance with the prior art.

FIG. 10A is an optical micrograph taken at about 100× of an area 10A of FIG. 10 after a head-forging process to define a head for a tool in accordance with the prior art.

Figure 11:
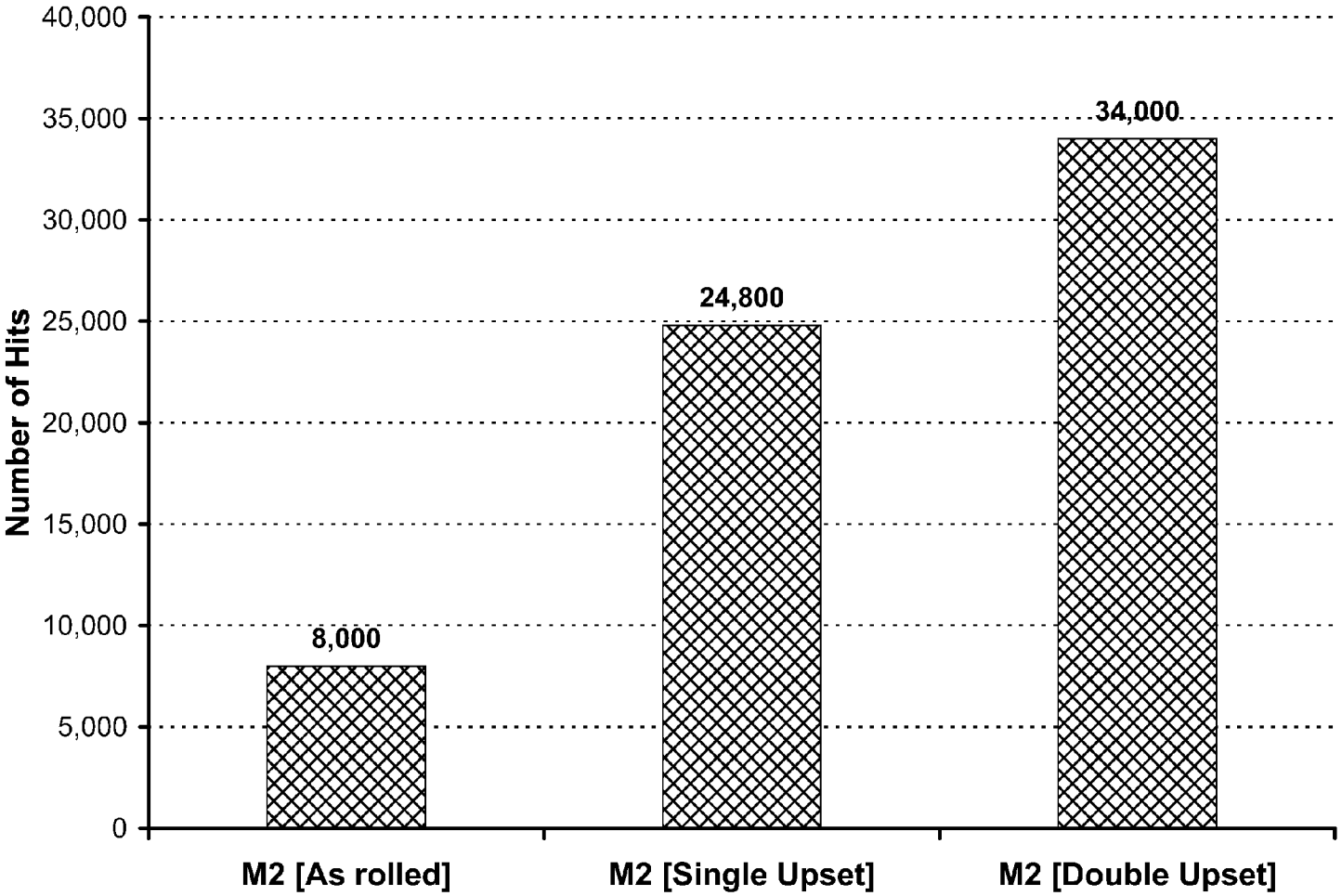

FIG. 11 is graphical representation of the influence of thermo-mechanical processing on tool service life in a metal-forming (i.e., piercing) application for a tool in accordance with an embodiment of the invention.

Figure 12:
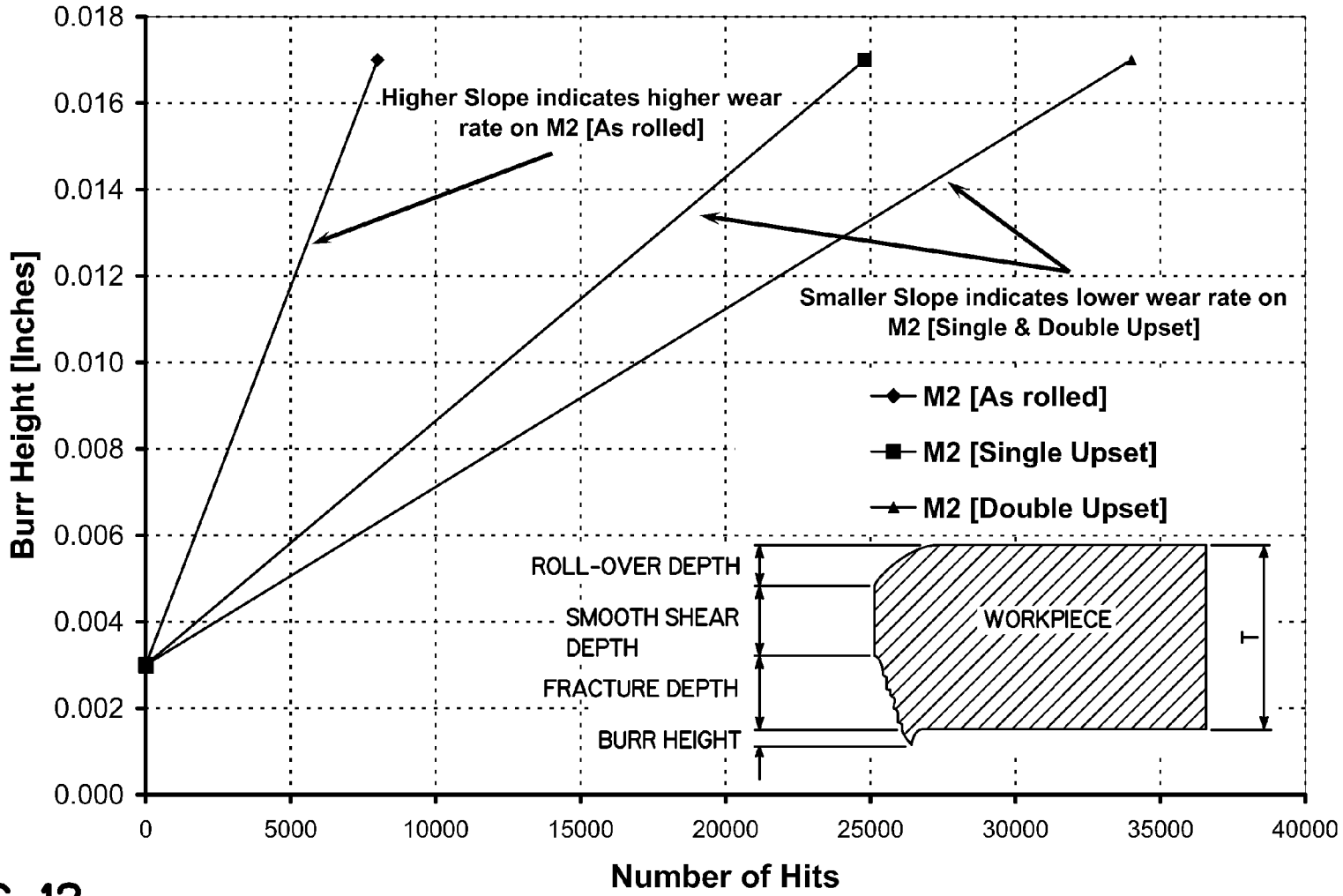

FIG. 12 is a graphical representation of the influence of processing method on wear rate in a metal-forming (i.e., piercing) application for a tool in accordance with an embodiment of the invention.

Figure 13A:
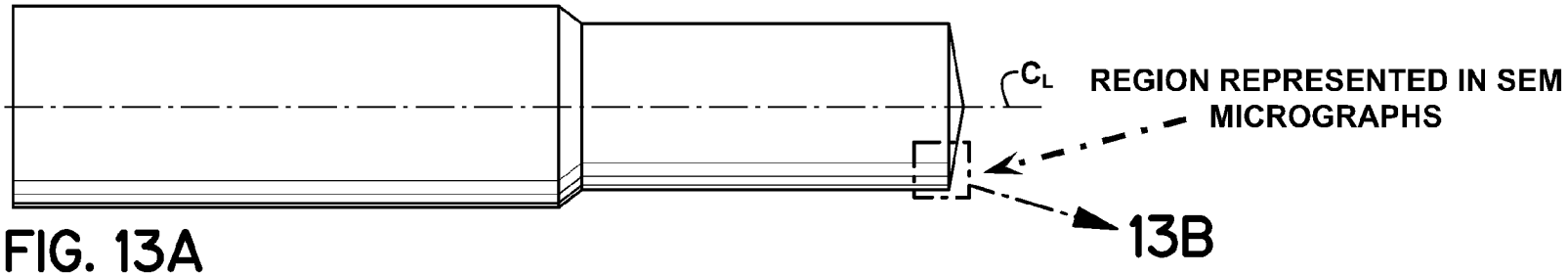

FIG. 13A is a schematic side view of a punch with a thermo-mechanically processed tip and working surface that was used in the metal-forming application to acquire the data shown in FIGS. 11 and 12.

Figure 13B:
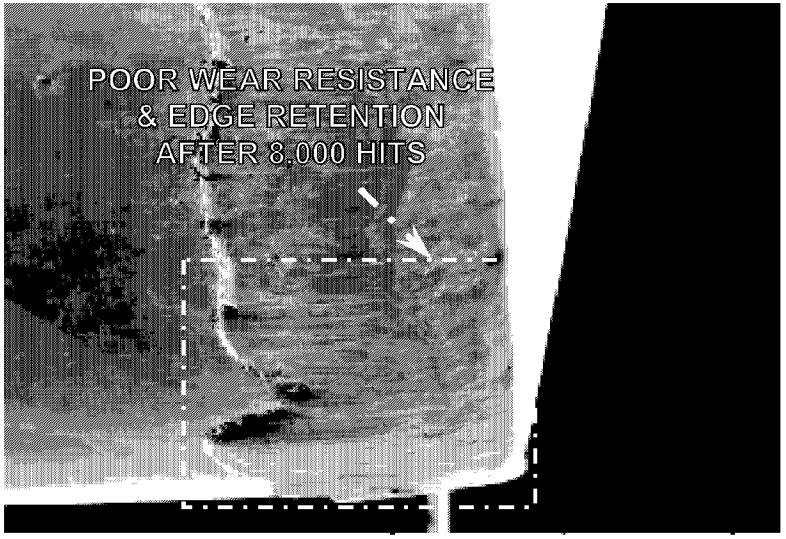

FIG. 13B is an electron micrograph of the cutting edge as indicated from the enclosed area 13B of FIG. 13A of a conventional punch formed from M2 grade tool steel in the as-rolled condition in accordance with the prior art and used to acquire the data for the conventional punch shown in FIGS. 11 and 12.

Figure 13C:
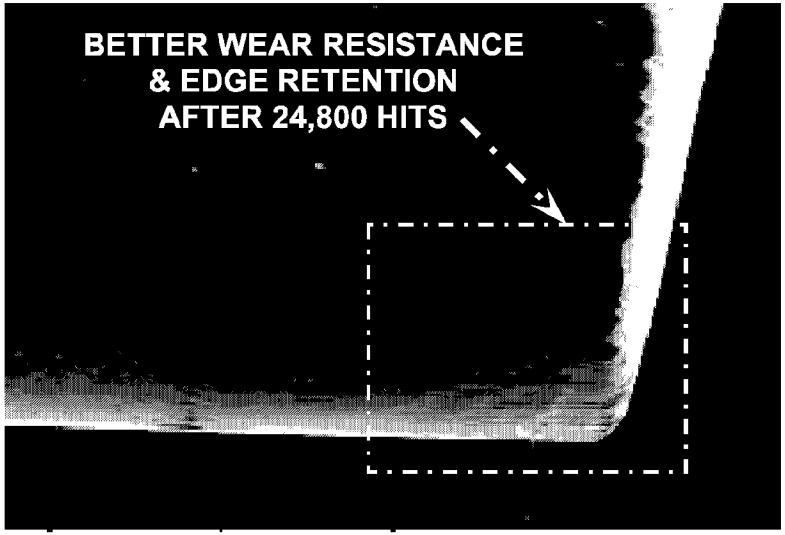

FIG. 13C is an electron micrograph of the cutting edge as indicated from the enclosed area 13B of FIG. 13A of a punch that includes the thermo-mechanically processed tip and working surface in accordance with an embodiment of the invention and used to acquire the data for the punch shown in FIGS. 11 and 12.

Figure 14:
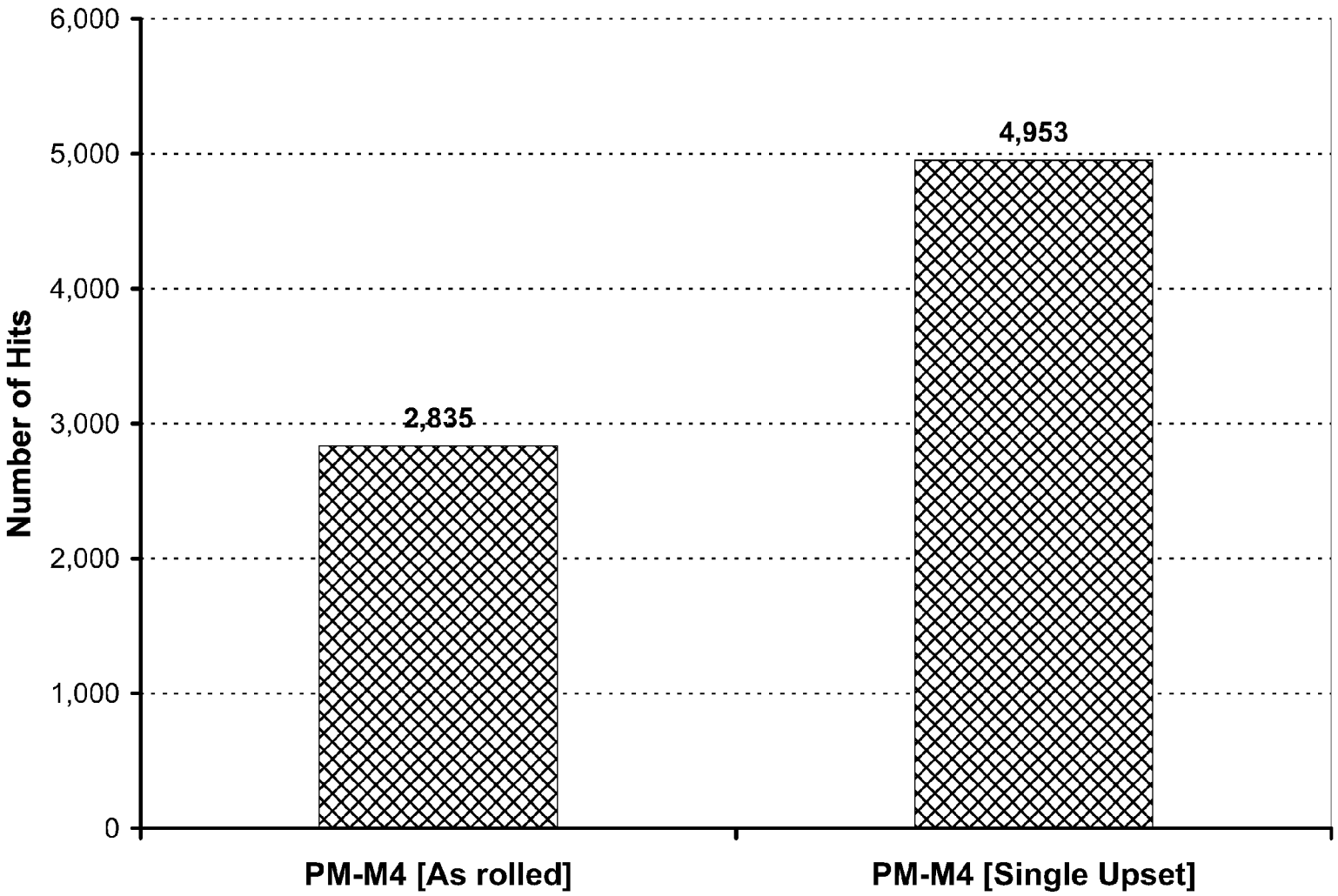

FIG. 14 is a graphical representation showing the influence of thermo-mechanical processing on tool life in a machining (i.e., broaching) application for a broach in accordance with an embodiment of the invention and a broach in accordance with the prior art.

Figure 15B:
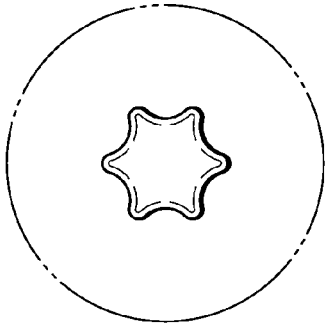
Figure 15A:
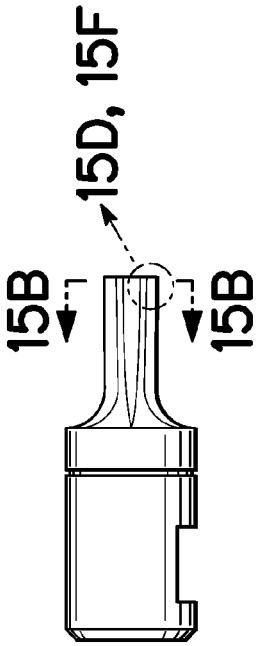

FIGS. 15A and 15B are a side view and an end view, respectively, of a tool according to one embodiment of the invention having a broach configuration and used in the machining application to acquire the data of FIG. 14.

Figure 15E:
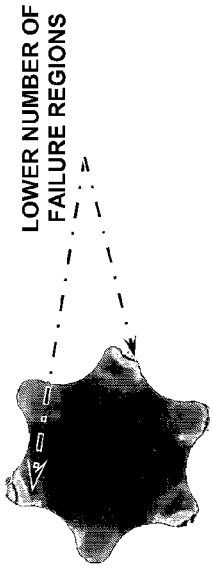
Figure 15C:
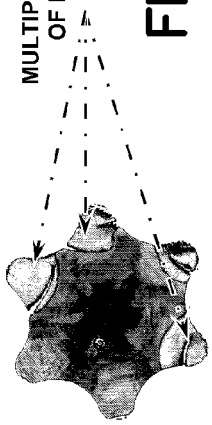
Figure 15F:
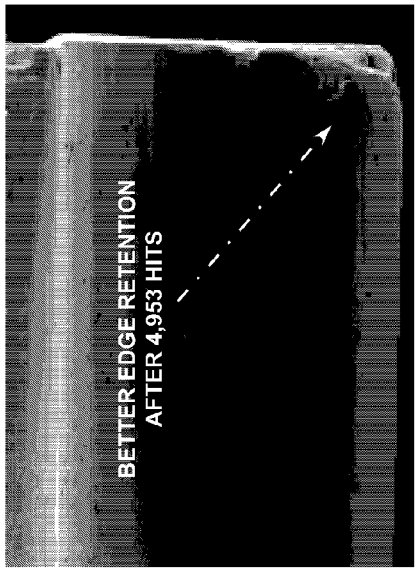
Figure 15D:
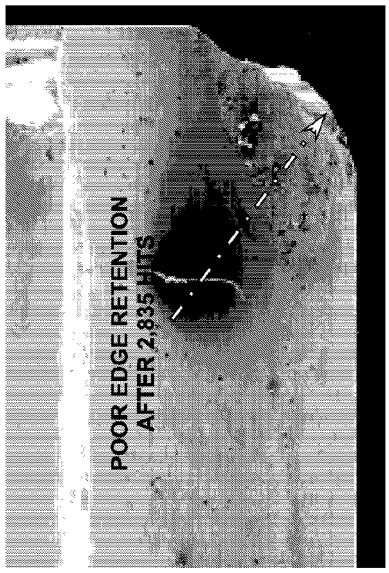

FIGS. 15C and 15D are an optical micrograph of a working surface and an electron micrograph of encircled area 15D, 15F of FIG. 15A, respectively, of a broach that is formed from a conventional M4-grade powder metal tool steel in accordance with the prior art.

FIGS. 15E and 15F are an optical micrograph of a working surface and an electron micrograph of encircled area 15D, 15F of FIG. 15A, respectively, of a broach in accordance with an embodiment of the invention formed from M4-grade powder metal tool steel that has a working tip that has been thermo-mechanically processed.

DETAILED DESCRIPTION

Figure 3:
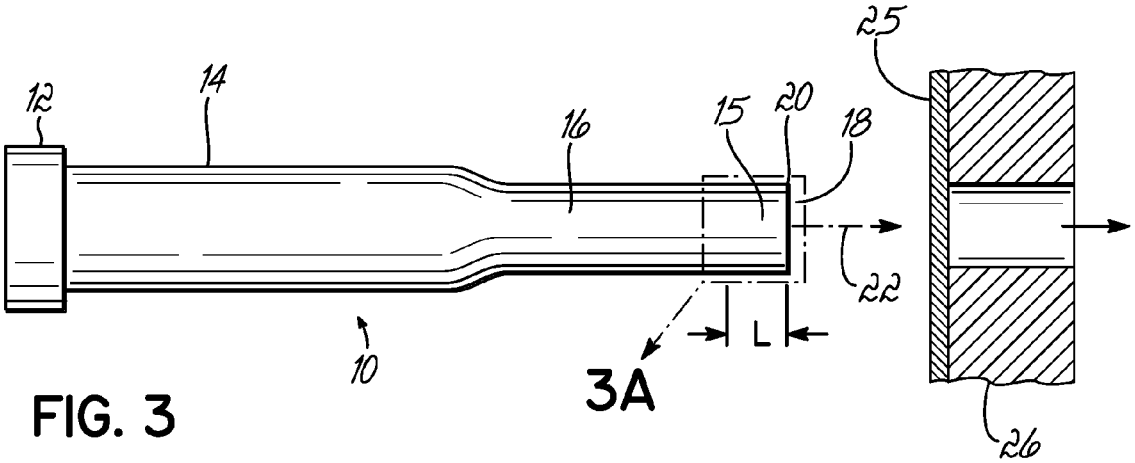
FIG. 3 is a plan view of a tool in accordance with a representative embodiment of the invention.

With reference to FIG. 3 and in accordance with a representative embodiment, a tool 10 is an elongate member that includes a barrel or shank 14, a head 12 disposed at one end of the shank 14, and a nose or body 16 with a tip 15 disposed at an opposite end of the shank 14 from the head 12. A working surface 18 carried on the tip 15 joins a sidewall of the tip 15 along a cutting edge 20. The cutting edge 20 and working surface 18 define the portion of the tool 10 that contacts the surface of a workpiece 25. The workpiece 25 may comprise a material to be processed by the tool 10 in a metal-forming application, such as a thin metal sheet.

When viewed along a longitudinal axis or centerline 22 of the tool 10, the shank 14 and body 16 of the elongate member have a suitable cross-sectional profile, such as, for example, a round, rectangular, square or oval cross-sectional profile. The shank 14 and body 16 may have cross-sectional profiles of identical areas or the body 16 may have a smaller cross-sectional area to provide a relief region between the shank 14 and body 16. In certain embodiments, the shank 14 and body 16 are symmetrically disposed about the centerline 22 and, in particular, may have a circular or round cross-sectional profile centered on and/or symmetrical about the centerline 22.

The head 12 of the tool 10 has a construction appropriate for being retained with a tool holding device used with a metalworking machine like a machine tool or a press (not shown). In the exemplary embodiment, the head 12 is a flange having a diameter greater than the diameter of the shank 14. Instead of head 12, the tool 10 may alternatively include a ball-lock retainer, a wedge-lock retainer, a turret, or another type of retaining structure for coupling the shank 14 of tool 10 with a tool-retaining device.

The tool 10, which has the construction of a punch in the representative embodiment, typically forms a component of a die set for use in a stamping operation. The die set further includes a die 26 containing an opening that receives a portion of the tip 15 of tool 10. The die 26 and tool 10 cooperate, when pressed together, to form a shaped hole in a workpiece or to deform the workpiece 25 in some desired manner. The tool 10 and the die 26 are removable from the metalworking machine with the tool 10 being temporarily attached by using a tool retention mechanism to the end of a ram. The tool 10 moves generally in a direction towards the workpiece 25 and with a load normal to the point of contact between the working surface 18 and the workpiece 25. The metalworking machine may be driven mechanically, hydraulically, pneumatically, or electrically to apply a load that forces the tool 10 into the workpiece 25. The tip 15 of tool 10 is forced under the high load imparted by the metalworking machine through, or into, the thicknesses of the workpiece 25 and into the die opening. The workpiece 25 is cut and/or deformed at, and about, the contact zone between the working surface 18 of tool 10 and the workpiece 25.

In an alternative embodiment of the invention, regions of the die 26 beneath one or more working surfaces of the die 26 may be formed from steel that has been thermo-mechanically processed in a manner consistent with the embodiments of the invention. Alternatively, for powder compaction applications, the workpiece 25 may comprise a powder housed in a recess of the die 26, instead of the representative sheet metal.

The tool 10 can be fabricated from various different classifications of steel including, but not limited to, tool steels like cold-work, hot-work, or high-speed tool steel grade materials, as well as stainless steels, specialty steels, and proprietary tool steel grades. The tool 10 may also comprise a powder metallurgical steel grade or, in particular, a powder metallurgical tool steel. Tool steel material grades are generally iron-carbon alloy systems with vanadium, tungsten, chromium and molybdenum that exhibit hardening and tempering behavior. The carbon content may be within a range from about 0.35 wt. % to about 1.50 wt. %, with other carbon contents contemplated depending on the carbide particles desired for precipitation, if any. In an alternative embodiment, the carbon content is within a range from about 0.85 wt. % to about 1.30 wt. %. The tool steel may exhibit hardening with heat treatment and may be tempered to achieve desired mechanical properties. Table 1 shows the nominal composition in weight percent of exemplary tool steel grades that may be used to fabricate the tool 10, the balance being iron (Fe).

TABLE 1

| AISI | DIN | JIS | UNS | C | Cr | V | W | Mo | Co |
|---|---|---|---|---|---|---|---|---|---|
| A2 | 1.2363 | G4404 SKD12 | T30102 | 1.00 | 5.00 | | — | 1.00 | — |
| D2 | 1.2201 | G4404 SKD11 | T30402 | 1.50 | 12.00 | 1.00 | — | 1.00 | — |
| H-13 | 1.2344 | G4404 SKD61 | T20813 | 0.35 | 5.00 | 1.00 | — | 1.50 | — |
| M2 | 1.3341 | G4403 SKH1 | T11302 | 0.85~1.00 | 4.00 | 2.00 | 6.00 | 5.00 | — |
| M4 | — | G4403 SKH54 | T11304 | 1.30 | 4.00 | 4.00 | 5.50 | 4.50 | — |
| S7 | — | — | T41907 | 0.50 | 3.25 | 0.25 | — | 1.50 | — |
| T15 | — | G4403 SKH10 | T12105 | 1.57 | 4.00 | 5.00 | 12.25 | — | 5.00 |
| M42 | S-2-10-1-8 | G4403 SKH59 | T11342 | 1.08 | 3.75 | 1.1 | 1.5 | 9.5 | 8.00 |

The tip 15 of body 16 near the working surface 18 is subjected to a thermo-mechanical process that alters the morphology or microstructure of the material of the tool 10 by heating at least the tip 15 and applying a force to the tip 15. In particular, the thermo-mechanical process modifies the constituent microstructure of the tip 15 in a region L, such that the service life of the tool 10 in machining and metal-forming applications is significantly prolonged, but does not modify the composition of the tool steel. In one embodiment, region L intersects the working surface 18 and, therefore, region L may be measured along the length of the tip 15 of body 16 relative to the working surface 18. In specific embodiments, the structurally modified region L may extend a distance of between 0.125 inches (0.3175 centimeters) and 0.25 inches (0.635 centimeters) along the tip 15 from the working surface 18. In other specific embodiments, the structurally modified region L may extend a distance greater than about 0.001 inches (about 0.00254 centimeters) along the tip 15 from the working surface 18.

The extended service life may arise from a change in the directionality of the carbide and/or alloy banding in region L.

Figure 3A:
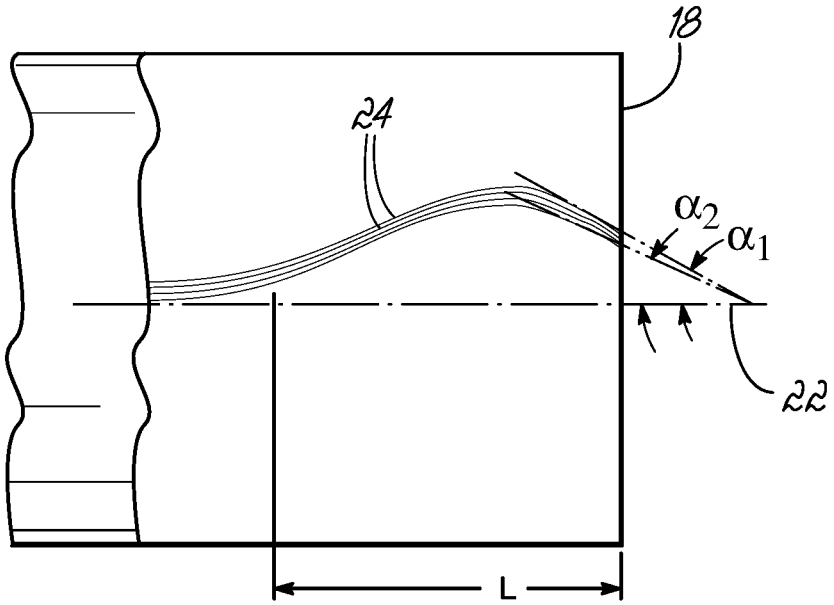
FIG. 3A is a schematic cross-sectional view diagrammatically illustrating the carbide and/or alloy banding in region, L, of the tool in FIG. 3 after modification by thermo-mechanical processing in accordance with an embodiment of the invention.

In particular, the thermo-mechanical process may operate to misalign the carbide and/or alloy bands in region L such that adjacent bands are no longer aligned parallel to each other and with the centerline 22, as schematically shown in FIG. 3A. In one specific embodiment, the carbide and/or alloy bands 24 may have non-linear alignment in region L. In particular and in one embodiment, an inclination angle, $\alpha_1$, of at least one of the carbide and/or alloy bands 24 may transition from approximate alignment with the centerline 22 outside of the thermo-mechanically modified region, L, to significant misalignment or nonalignment with the centerline 22 inside region, L. Specifically, the inclination angle, $\alpha_1$, of at least one of the carbide and/or alloy bands 24 has a positive slope relative to the centerline 22 over a portion of region, L, near the working surface 18 and a negative slope over another portion of region, L. The transition between the positively-sloped and negatively-sloped portions of the bands 24 is smooth, as is the transition from the negatively-sloped portion of the bands 24 to portions of the bands 24 outside of region, L, which are approximately aligned with the centerline 22.

In an alternative embodiment, the inclination angle, $\alpha_1$, may exhibit various different slopes, which may exhibit smooth or irregular transitions as the slope varies among the different slopes within the thermo-mechanically modified region, L. Moreover, an inclination angle, $\alpha_2$, of at least another of the carbide and/or alloy bands 24 may transition from approximate alignment with the centerline 22 outside of the thermo-mechanically modified region, L, to significant misalignment or nonalignment with the centerline 22 inside region, L. In addition, the inclination angle, $\alpha_2$, may differ from the inclination angle, $\alpha_1$, such that one of the carbide and/or alloy bands 24 appears to approach another of the carbide and/or alloy bands 24 in a converging manner. Similarly, one carbide and/or alloy band 24 may appear to diverge from another carbide and/or alloy band 24. In one embodiment, the carbide and/or alloy bands 24 may transition from approximate alignment with the centerline outside of the thermo-mechanically modified region, L, to an orientation such that the carbide and/or alloy bands 24 are not unidirectionally aligned. In some instances, adjacent pairs of the carbide and/or alloy bands 24 may appear to converge at some depths within region L while appearing to diverge from each other at other depths within region L so that the interband spacing varies with position along the centerline 22 in region L. In another alternative embodiment, all of the carbide and/or alloy bands 24 may exhibit the same changes in inclination angle, $\alpha_1$, over the length of the thermo-mechanically modified region, L, so that the inter-band spacing is approximately constant.

This morphological modification producing the misaligned carbide and/or alloy bands locally in region, L, may operate to improve the mechanical properties of the tool 10. In particular, the resistance of the tool steel to brittle fracture is believed to be greatly improved by eliminating directionality in the carbide and/or alloy banding in the modified region, L. Regions of the body 16 and shank 14 outside of the modified region, L, may not be modified by the thermo-mechanical process and, therefore, these regions may exhibit the directionality of the carbide and/or alloy bands characteristic of hot worked tool steel, like hot rolled tool steel. The improvement in mechanical properties for tip 15 is independent of the tool retaining mechanism used in tool 10.

With reference to FIG. 4A in which like reference numerals refer to like features in FIG. 3 and in accordance with an embodiment of the invention, the tool 10 (shown in FIG. 3) may be fabricated by shaping a preform or blank, such as the representative blank 30, with the thermo-mechanical treatment process. Blank 30 has a tip 32 that is at least partially shaped by the thermo-mechanical process during the fabrication of the tool 10. The microstructural morphology of the tool steel comprising blank 30, which is formed from rolled steel, initially includes directional carbide and/or alloy bands similar to those shown in the optical micrograph of FIG. 1 and aligned generally along the centerline 22. The tip 32, which has the shape of a truncated cone or a frustoconical shape, tapers along its length and terminates at a blunt end 33. Following the thermo-mechanical treatment process and any subsequent secondary processes, tip 32 defines the tip 15 of tool 10 and includes the working surface 18 (FIG. 3). The remainder of the blank 30 defines the head 12, shank 14, and the remainder of the body 16 of tool 10. The extended service life may be influenced by additional morphological modifications. For example, the carbide and/or alloy bands in region L may be compressed more tightly together. That is, the distance between adjacent bands may be less resulting in a higher density of bands in a given area than in other regions. The higher density of bands in region L may further operate to improve the mechanical properties of the tool 10.

The geometry or shape of the initial blank 30, before the application of the thermo-mechanical processing, will impact the resultant microstructure in region L of the tool 10, for example, like the tool 10 illustrated in FIG. 3. The geometry of the blank 30 may be selected based upon the type of thermo-mechanical process employed and the targeted final geometry for the tool 10. For a given thermo-mechanical process, the geometry of the blank 30 can comprise cylindrical rod stock, rectilinear bar stock, coil stock, or stock material having other, more complex shapes and cross-sectional profiles. The determination of preform geometry may be developed based on past experience, tooling requirements, and process limitations. For example, a minimum upset ratio of about 2:1 may be specified from process limitations to provide a microstructure that provides a perceivable improvement in the mechanical properties. The improvement in mechanical properties is believed to increase with increasing upset ratio.

The blank 30 with a frustoconical tip 32 (for example, blank 30 illustrated in FIG. 4A) may be particularly suitable for use as a preform in a hot upsetting process to impart the desired mechanical properties to the tool steel comprising tool 10. The frustoconical tip 32 of the blank 30 may be formed by machining in a lathe, shaped by swaging, etc. Machining may remove some of the material along the exterior during formation of the tip 32. The removed material may contain less carbide than, for example, the remaining material forming the tip 32. In a hot upsetting process, the tip 32 is expanded radially by the thermo-mechanical process relative to the centerline 22 as is more fully described with reference to FIGS. 6A-6C below. The extended service life of tool 10 may be influenced by additional morphological modifications. For example, removing a portion of the relatively lower carbide containing material prior to thermo-mechanical processing may provide greater carbide content at and/or near the working surface 18 following thermo-mechanical processing.

Suitable thermo-mechanical treatments include, but are not limited to, forging processes such as radial forging, ring rolling, rotary forging, swaging, thixoforming, ausforming, and warm/hot upsetting. For upset forging, also referred to simply as upsetting, single or multiple upsetting may be used to shape the blank 30. After the conclusion of the thermo-mechanical treatment process, the blank 30 may be heat treated, finish machined, and ground to supply any required tooling geometry as found in conventional tools.

Figure 4B:
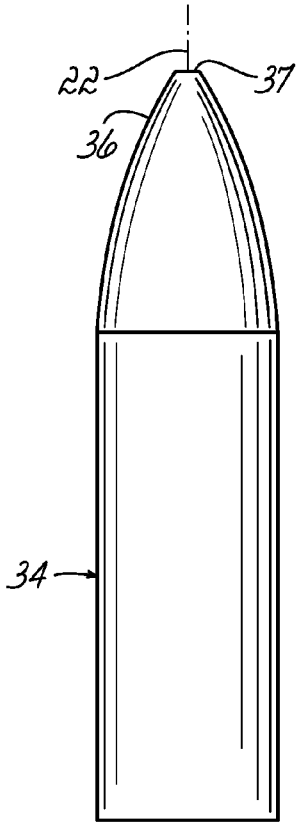

With reference to FIG. 4B in which like reference numerals refer to like features in FIG. 3 and in accordance with an alternative embodiment, a blank 34 having a "bullet-shaped" tip 36 may be shaped by thermo-mechanical treatment into tool 10. Tip 36 tapers with a curvature along its length and terminates at a blunt end 37. The microstructural morphology of the tool steel comprising blank 34, which is formed from rolled steel, initially includes carbide and/or alloy bands similar to those shown in the optical micrograph of FIG. 1. Following the thermo-mechanical treatment process and any optional finish machining and grinding, tip 36 defines the tip 15 of the tool 10, for example, like the tool 10 depicted in FIG. 3, and includes the working surface 18. The remainder of the blank 34 defines the head 12, shank 14, and the remainder of the body 16 of the tool 10.

Figure 4C:
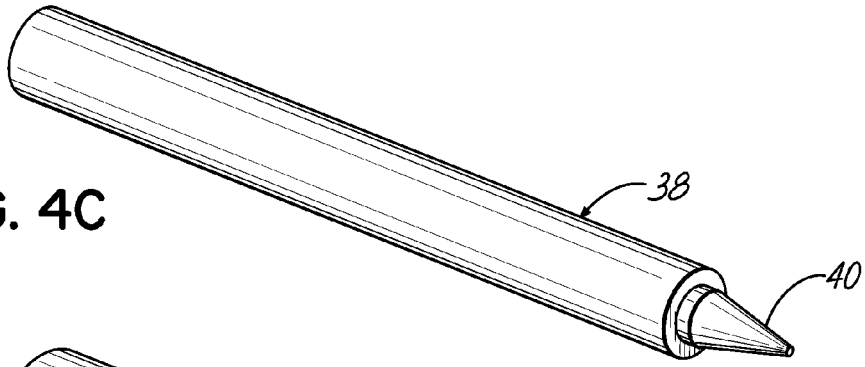
FIGS. 4C and 4D are perspective views of preforms or blanks that can be used to fabricate the tool of FIGS. 5A and 5B, respectively.
Figure 5A:
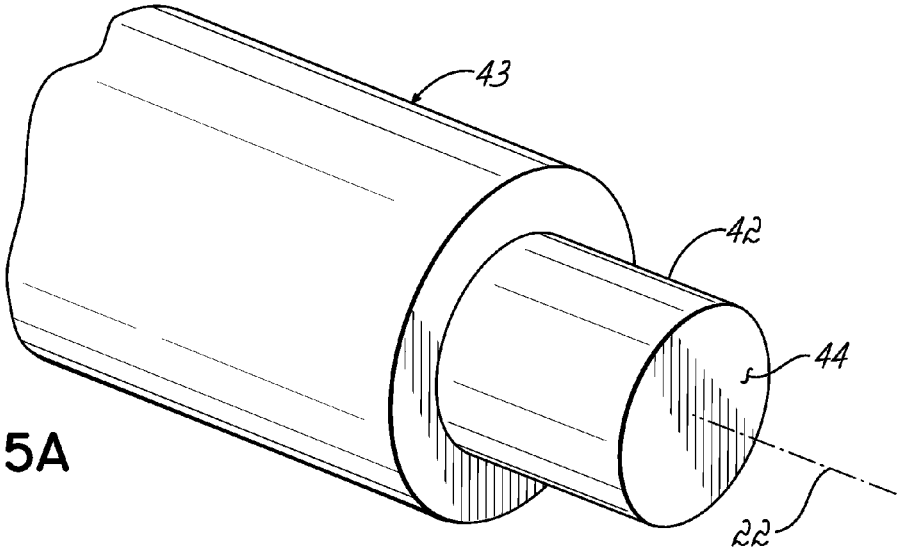
FIGS. 5A and 5B are perspective views of embodiments of tools according one aspect of the invention.

With reference now to FIG. 4C in which like reference numerals refer to like features in FIG. 3 and in another alternative configuration, the blank 38 having a smaller diameter tip 40 than tip 32 (FIG. 4A) and tip 36 (FIG. 4B) may be shaped by thermo-mechanical treatment into a tool 43, such as shown in FIG. 5A. The tip 40, shown in FIG. 4C, tapers along its length and has a smaller diameter than the remainder of the blank 38. Following thermo-mechanical treatment and any optional finish machining and grinding, the tip 40 defines a tip 42 of the tool 43 having a working surface 44 shown in FIG. 5A. In accordance with one aspect of the invention, to achieve a tool having a small tip or working surface configuration, a blank having a relatively small tip compared to the remaining portion of the blank, like that shown in FIG. 4C, may be utilized such that the upset ratio is maximized.

Figure 4D:
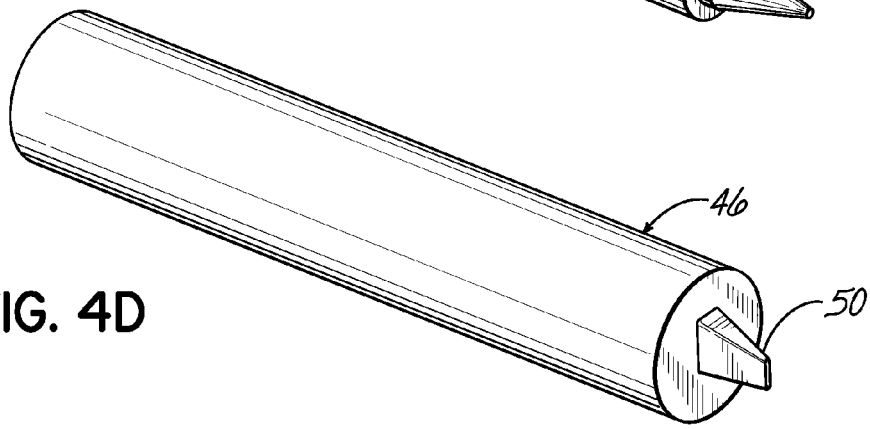
Figure 5B:
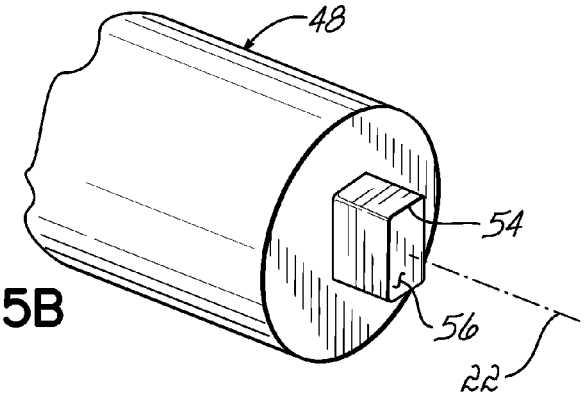

FIG. 4D illustrates another exemplary embodiment of a blank 46 utilized to thermo-mechanically form a tool having a relatively small tip, such as a tool 48 shown in FIG. 5B. The blank 46 has a tapered rectangular tip 50. Following thermo-mechanical treatment, the tip 50 defines, for example, a tip 54 of tool 48 shown in FIG. 5B. The tip 54 has a rectangular shaped working surface 56. While various embodiments of blanks 30, 34, 38, 46 are illustrated and described above, blanks are not limited to those shown. In addition, the tip 15, 42, 54 of the tool 10, 43, 48 may be any shape. Furthermore, the shape may be determined by the metal-forming or machining application.

With reference to FIGS. 6A and 6B in which like reference numerals refer to like features in FIG. 3 and in accordance with another embodiment, a tip 62 of a blank 60, which is similar to blank 30 (FIG. 4A), is subjected to a single-stage thermo-mechanical process that modifies the microstructure of tip 62. The blank 60 initially contains a microstructure with carbide and/or alloy bands aligned approximately along the centerline 22 of blank 60. The tip 62 of the blank 60 is machined by, for example, lathe turning into a truncated conical shape, as best shown in FIG. 6A, having an included angle 01. Next, the tip 62 is subjected to a hot-upsetting thermo-mechanical process that deforms the tip 62 into a more cylindrical shape, as best shown in FIG. 6B. A larger included angle 01 may be a result of the thermo-mechanical process. Typically, the hot-upsetting thermo-mechanical process deforms the tip 62 such that tip 62 no longer has an included angle or the included angle may approach 180° (for example, the tip 62 may have a substantially cylindrical appearance as shown in FIG. 6B). The processing temperature range can vary depending on parameters such as the specific thermo-mechanical process, the part size, the part material, etc. In certain embodiments, the processing temperature may be above the lower transformation temperature, i.e., the $AC_1$ temperature, at which the structure of the constituent tool steel begins to change from ferrite and carbide to austenite when being heated. The hot-upsetting thermo-mechanical process alters the microstructure in the tip 62 such that the carbide and/or alloy bands deviate from the alignment parallel to the centerline 22 that is characteristic of the material before the thermo-mechanical process is performed. After processing, all or a portion of tip 62 defines the tip 15 (FIG. 3) containing the modified carbide and/or alloy bands.

With reference now to FIGS. 6C and 6D in which like reference numerals refer to like features in FIG. 3 and in accordance with another embodiment, blank 60 (shown in FIG. 6B) may be machined or hot forged, after the single stage thermo-mechanical process, to form a blank 70 having a tip 72 with a truncated conical shape. The initial included angle $\theta_2$ in FIG. 6C of the tip 72 may differ from the included angle $\mathbf{0}_1$ of the tip 62 of blank 60. For example, the initial included angle $\theta_2$ of tip 72 may be about 20° and the initial included angle $\theta_1$ of tip 62 may be about 16°.

Next, the tip 72 is subjected to a second hot-upsetting thermo-mechanical process that deforms the tip 72 into a more cylindrical shape, as best shown in FIG. 6D. The second hot-upsetting thermo-mechanical process reduces the included angle θ of the tip 72. The processing temperature range can vary depending on parameters such as the specific thermo-mechanical process, the part size, the part material, etc. The second hot-upsetting thermo-mechanical processes further modifies the microstructure in the tip 72, which may act to further increase the deviation of the carbide and/or alloy bands from alignment along the centerline 22. The application of multiple thermo-mechanical processes may modify the microstructure of the tip 72 to further enhance the improvement in mechanical properties. After processing, all or a portion of tip 72 defines the tip 15 (FIG. 3) containing the modified carbide and/or alloy bands.

After the thermo-mechanical process is used to alter the alignment of the carbide and/or alloy bands, a secondary process may be used to further modify the tip 15 (FIG. 3) of the tool 10 to shape the tip 15 for a particular application or to impart additional improvements in tool life. For example and with reference to FIG. 5C, a tip 74 may be machined from the tip 42 shown in FIG. 5A. Moreover, the tip 74 may include a concave cutout 76 adapted to provide shearing action when forcibly engaged with a workpiece. While the blanks illustrated herein are depicted as generally cylindrically shaped, the blanks are not limited to generally cylindrical shapes, as other shapes will suffice or may be required depending on, for example, the final application, the workpiece, or even available bar stock.

Exemplary secondary processes include thermal spraying or cladding the working surface of the tool 10 with one or more wear resistant materials. Other secondary process may include applying a coating on the working surface of the tool 10 by a conventional coating techniques including, but not limited to, physical vapor deposition (PVD), chemical vapor deposition (CVD), or salt bath coatings. Other surface modification techniques may include ion implantation, laser or plasma surface hardening techniques, nitriding, or carburizing. These exemplary surface modification techniques may be used to modify a surface layer at the working surface of the tool. Additional secondary processes, such as edge honing, are contemplated by the invention for use in modifying the working surface of the tool 10. Furthermore, various different secondary processes may be used in any combination for further modifying tip 15.

The tool 10 may have other punch constructions that differ from the construction of the representative embodiments. As examples, tool 10 may be configured as a blade, a heel punch, a pedestal punch, a round punch, etc. Although tool 10 is depicted as having a construction consistent with a punch in the representative embodiment, a person having ordinary skill will understand that the tool 10 may have other constructions. In particular, tool 10 in the form of punch or stripper may be applied in metal stamping and forming operations like piercing and perforating, fine blanking, forming, and extrusions or coining.

The tool 10 may also have the construction of a cutting tool, such as a rotary broach, a non-rotary broach, a tap, a reamer, a drill, a milling cutter, etc. Tool 10 may be used in casting and molding applications, such as conventional die casting, high pressure die casting, and injection molding. Tool 10 may also be utilized in powder compaction applications used in pharmaceutical processes, nutraceutical processes, battery manufacture, cosmetics, confectionary and food and beverage industries, and in the manufacture of household products and nuclear fuels, tableting, explosives, ammunition, ceramics, and other products. Tool 10 may also be used in automation and part fixturing applications, such as locating or part-touching details.

Figure 5C:
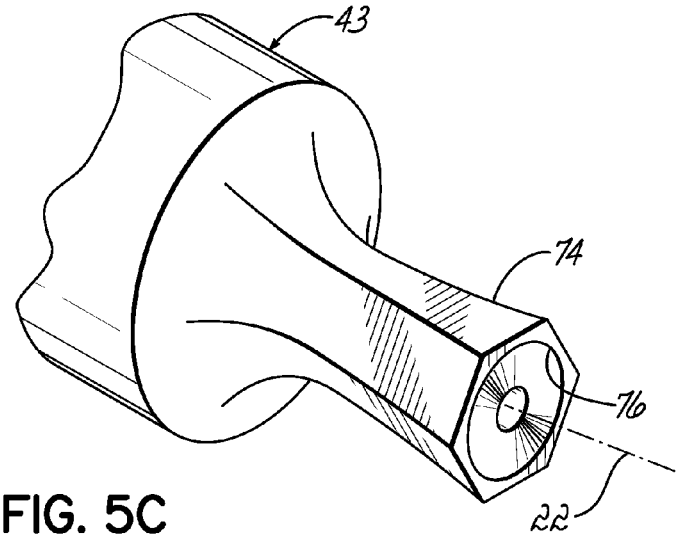

In an embodiment of the invention, tool 10 may be made by machining a thermo-mechanically processed end of an existing tool to define a tip 15 arranged along the centerline 22 with the shank 14, such as the tip 74 depicted in FIG. 5C. Because of the previous thermo-mechanical processing performed on the existing tool and before the machining, the tip 15 contains a region L having a microstructure with carbide and/or alloy bands that are not substantially aligned with the centerline 22 of the tip 15. The tip 15 may be further modified by additional thermo-mechanical processing to further modify the alignment of the carbide bands relative to the centerline 22 of the tip 15.

In another embodiment, tool 10 may be made by machining an end of an existing tool to define tip 15 arranged along the centerline 22 with the shank 14. The tip 15 contains carbide and/or alloy bands that are aligned with the rolling direction. The tip 15 is thermo-mechanically processed to modify an alignment of the carbide and/or alloy bands relative to the centerline 22 of the tip 15.

Further details and embodiments of the invention will be described in the following examples.

EXAMPLE 1

A conical blank or preform for a punch was prepared with a geometry as shown in FIG. 4A. The blank had an overall length of about 4.25 inches and a diameter of about 0.51 inches. The tip had a length dimension of about 0.7 inches with an included angle of about 16° such that the tip tapered to a blunt end having a diameter of about 0.070 inches. The conical blank was composed of a hot-rolled M2-type tool steel. The tip of the conical blank was thermo-mechanically processed using a single hot-upsetting type of thermo-mechanical process. Specifically, a fifty-ton horizontal hot-upsetting machine was used for thermo-mechanically processing the preform. The conical preform was locally heated at the tip using an induction heater to a targeted processing temperature before the tip was hot-upset forged from the conical shape to a cylindrical shape. The processing temperature of the tip was in a temperature range of about 1652° F. (about 900° C.) to about 1742° F. (about 950° C.). The processed cylindrical bars were then used to conventionally manufacture a tool having the shape of a punch. Care was taken during tool manufacture to make sure that the tool working edge, i.e. tool edge and working surface that contacts the workpiece during use, was in the processed section.

After thermo-mechanical processing, the tip was sectioned longitudinally approximately along the centerline using a diamond saw, ground, and polished using standard metallographic sample preparation techniques. The polished sample was etched using a 3% nital solution (i.e., 3 vol. % nitric acid and the rest methanol), rinsed and dried.

FIG. 7 represents an optical micrograph of the etched sample taken with a stereoscope at a 14× magnification. The optical micrograph in FIG. 7, as well as the other optical micrographs herein, has been converted to a grayscale image. In addition, some of the optical micrographs herein have been embellished with lines intended to guide the eye. However, the addition of the guide lines has not altered the information contained in the original image.

Figure 1:
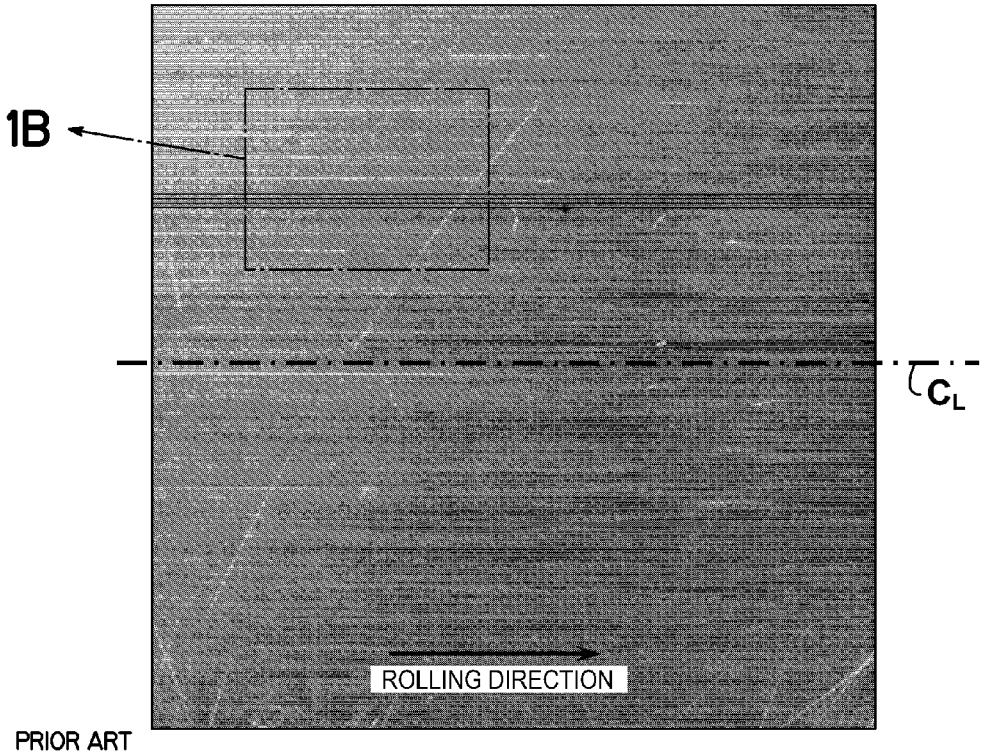
PRIOR ART FIG. 1
FIG. 1 is an optical micrograph taken at a magnification of about 14× showing a polished and etched region of a commercially available M2 tool steel grade bar stock with carbide and/or alloy banding apparent along the rolling direction in accordance with the prior art.

As readily apparent in FIG. 7, the microstructure in the unprocessed section (remote from the dashed box) shows unidirectional carbide and/or alloy banding similar to FIG. 1. However, the carbide and/or alloy banding in the processed section (enclosed inside the dashed box) has been modified to realign the carbide and/or alloy bands so that the carbide and/or alloy bands are not aligned with the centerline of the preform, which is believed to lead to an improvement in mechanical properties. The modification of the carbide and/or alloy bands is apparent from a comparison between the processed and unprocessed sections in FIG. 7.

In another, similar example, a tool prepared in accordance with Example 1 was heat treated and triple tempered. Following this preparation, the tool was cut and one of the cut specimens was polished and then etched with a 3% nital solution. Optical micrographs at about 100×, as shown in FIGS. 7A and 7B, of the specimen were taken in areas similar to those shown in FIG. 7 (as indicated by enclosed areas 7A and 7B, respectively). The working surface of the tip of a tool made from this processed blank is on the terminal face of the processed region and the tip has a centerline substantially as indicated in FIG. 7.

Figure 1A:
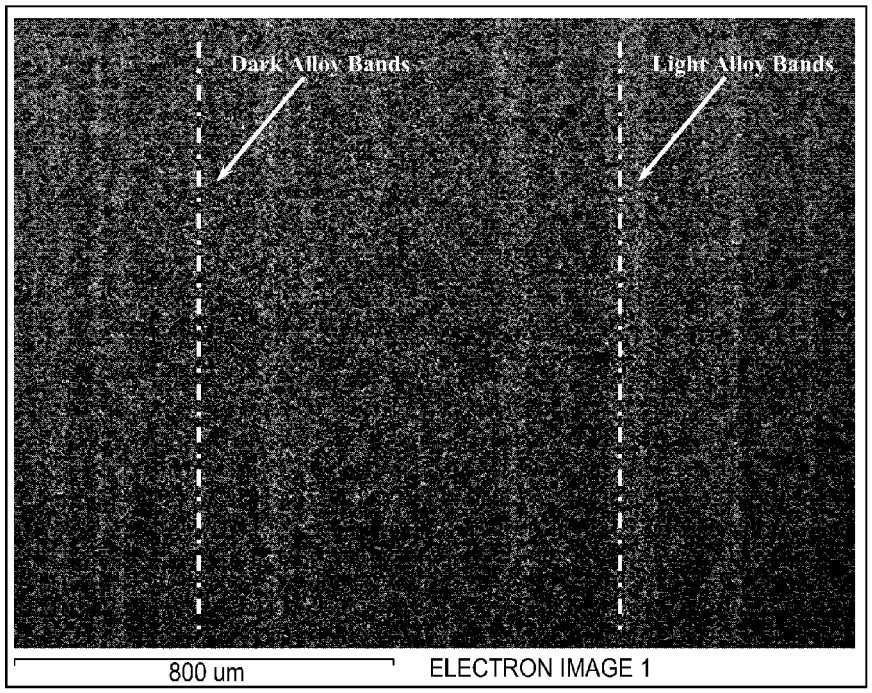
PRIOR ART FIG. 1A
FIG. 1A is an SEM micrograph at a magnification of about 130× showing a polished region of a commercially available S7 tool steel grade bar stock with alloy banding apparent along the rolling direction in accordance with the prior art.
Figure 1B:
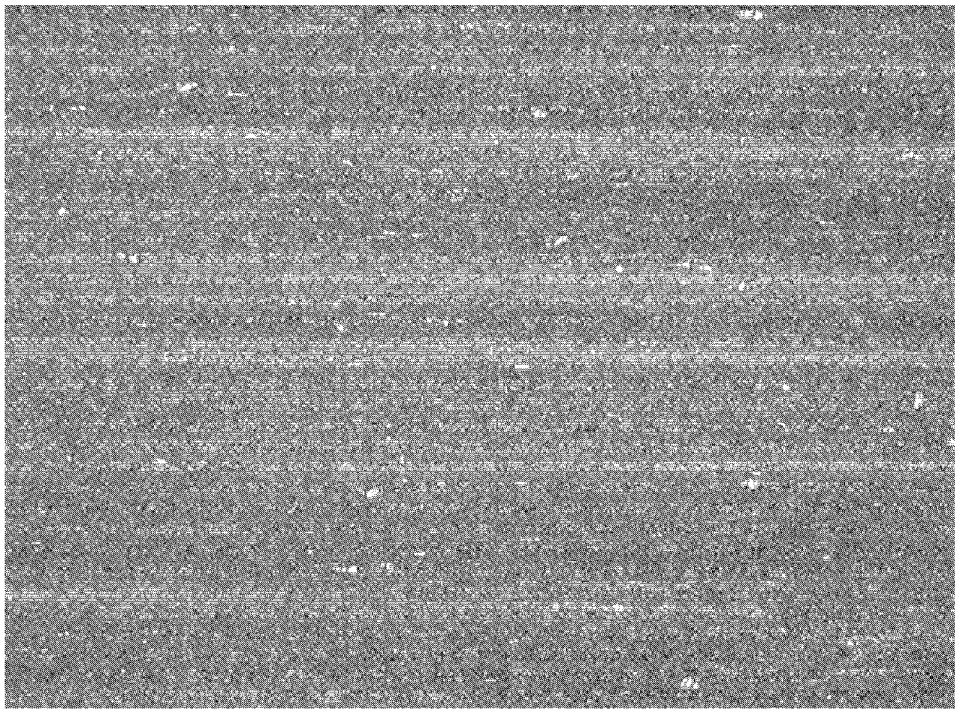
PRIOR ART FIG. 1B
FIG. 1B is an optical micrograph taken at a magnification of about 100× showing a polished and etched region of a commercially available M2 tool steel grade bar stock with carbide and/or alloy banding apparent along the rolling direction in accordance with the prior art.

With reference now to FIG. 7A, a magnified view of a processed section of the tool is provided. As is apparent from FIGS. 7 and 7A, the carbide/alloy banding is not substantially aligned with the longitudinal axis of the tool (represented by centerline, $C_L$, in FIG. 7). Furthermore, measurements of interband spacing in FIG. 7A (one exemplary measurement is shown in FIG. 7A extending from one light band to an adjacent light band), made in accordance with procedures described with reference to FIG. 1A, indicate an average interband spacing of approximately 87 μm with a standard deviation of the average of approximately 13 μm.

FIG. 7B is another magnified view of an area different from the area depicted in FIG. 7A of the processed section of the tool as illustrated in FIG. 7. Interband spacing measurements of carbide/alloy banding of FIG. 7B indicate an average interband spacing of approximately 68 μm with a standard deviation of the average of about 12 μm. By contrast, measurements of interband spacing of an unprocessed section of the tool indicate spacing similar to that provided in the description of FIG. 1A. The unprocessed section of the tool, therefore, appears unchanged from the as-rolled condition. With reference to the average interband spacing measurements, provided with reference to FIGS. 7A and 7B, the processed sections are characterized by about a 150% to 200% decrease in interband spacing compared to the as-rolled or unprocessed section within the same tool. In other words, the interband spacing in the processed section is less than the interband spacing in the unprocessed section.

Additionally, from the measurements, it is also believed that there is a gradient in the interband spacing from a peripheral surface to a longitudinal axis of the tool. For example, in the exemplary embodiment illustrated in FIG. 3, in a processed section, the interband spacing may gradually increase along a radial line from the outer peripheral surface to a radial midpoint and then decrease from the radial midpoint to the center of the tool. Another gradient in the interband spacing may be observed along a direction parallel to, and positioned radially from, the longitudinal axis through the processed section into the unprocessed section. For example, starting at a working surface, the interband spacing may initially decrease through the processed section and then increase as the unprocessed section is approached. It is expected that similar interband spacing would be observed for tools made via powder metallurgy.

EXAMPLE 2

A conical blank and process similar to that described in Example 1 was fabricated except that an additional hot upsetting thermo-mechanical process was performed. FIG. 8 shows an optical micrograph of an as-rolled bar stock specimen or preform after being subjected to two, discrete hot upsetting thermo-mechanical processes. The microstructure in the unprocessed section (remote from the dashed box) shows unidirectional carbide and/or alloy banding similar to FIG. 1. However, the carbide and/or alloy banding in the processed section (enclosed inside the dashed box) has been modified to realign the carbide and/or alloy bands so that the carbide and/or alloy bands are not aligned with the centerline of the preform, which is believed to lead to an improvement in mechanical properties. The modification of the carbide and/or alloy bands is apparent from a comparison between the processed and unprocessed sections in FIG. 8. It is also believed that two, discrete hot upsetting thermo-mechanical processes decrease the interband spacing compared to the tool prepared according to Example 1 by, for example, at least 50%. The working surface of the tip of a tool made from this processed blank is on the terminal face of the processed region and the tip has a centerline substantially as indicated in FIG. 8.

EXAMPLE 3

FIG. 9 shows an optical micrograph of a powder metallurgical M4-grade tool steel as-rolled bar stock specimen or preform after thermo-mechanical processing using a single hot-upsetting process. The microstructure in the unprocessed section (remote from the dashed box) shows unidirectional carbide and/or alloy banding similar to FIG. 2. However, the carbide and/or alloy banding in the processed section (enclosed inside the dashed box) has been modified to realign the carbide and/or alloy bands so that the carbide and/or alloy bands are not aligned with the centerline of the preform, which is believed to lead to an improvement in mechanical properties. The modification of the carbide and/or alloy bands is apparent from a comparison between the processed and unprocessed sections in FIG. 9. The working surface of the tip of a tool made from this processed blank is on the terminal face of the processed region and the tip has a centerline substantially as indicated in FIG. 9.

COMPARATIVE EXAMPLE 1

FIG. 10 shows a micrograph of a typical as-rolled bar stock blank after head-forging or head-upsetting to form a head in accordance with the prior art. In head forging, the head is deformed such that an overall dimension is expanded. For example, a 0.5 inch diameter steel preform may be head forged such that the head has a diameter of 0.625 inches. The head formed by head-forging is used to couple the resultant tool with a tool retaining device of a metalworking machine. When the tool is used, the head of the tool having a microstructure or alloy banding shown in FIG. 10 does not contact the workpiece or otherwise perform any operation on the workpiece. The hot forging process is one way to produce the head of the tool but not all tools require a shaped head. The microstructure in the head-forged section shows unidirectional carbide and/or alloy banding generally parallel to the centerline of the specimen and the rolling direction similar to the aligned carbide and/or alloy bands visible in FIG. 1.

With reference now to FIG. 10A, the carbide and/or alloy banding in the head-forged section is modified by the head-forging to have a more widely spaced pattern with larger separations between adjacent carbide and/or alloy bands. In other words, an interband spacing between adjacent bands is greater in the head-forged section than in the unprocessed section. Measurements of the interband spacing in the head-forged region shown in FIG. 10A indicate an average interband spacing in this area of approximately 162 μm with a standard deviation of the average of approximately 5 μm. During head forging, a cylindrical-shaped head deforms into a larger diameter cylinder with the carbide and/or alloy bands being displaced radially. Since the final diameter of the head-forged section is larger than the initial diameter of the preform, the carbide and/or alloy bands may spread apart in proportion to the overall radial expansion.

EXAMPLE 4 AND COMPARATIVE EXAMPLE 2

Punches were formed from the preforms of Examples 1 and 2 with the working surface and underlying portion of the body formed from the thermo-mechanically modified M2 grade tool steel. The punches were used to pierce 0.5 inch diameter holes in workpieces comprising 0.125 inch thick re-rolled 125,000 psi yield strength rail steel. Two parameters, the number of cycles or parts/hits and the burr height (both generally accepted as standard indicators of tool life and wear in the metal-forming industry), were used as benchmark in this piercing application. During use, the punches were held using a ball-lock tool retention mechanism.

As shown in FIG. 11, the punch made from the thermo-mechanically modified preform of Example 1 exhibited a tool service life improvement of about 3.1 times in comparison with a comparable punch manufactured from conventional as-rolled M2 grade tool steel. Specifically, and as apparent in FIG. 11, the conventional M2-grade steel punch lasted for 8,000 hits while the modified M2-grade steel punch made from the preform of Example 1 lasted 24,800 hits and the modified M2-grade steel punch made from the preform of Example 2 lasted about 34,000 hits.

As shown in FIGS. 12 and 13A-C, similar improvements in wear resistance and edge retention are also evident for the thermo-mechanically processed punches in comparison with the conventional punch. The thermo-mechanically processed M2-grade tool steel punches exhibited a slower rate of wear, as indicated by the smaller slope, and better edge retention than the conventional M2 tools as is graphically illustrated in FIG. 12. This slower rate of wear may be favored in high precision applications, wherein such thermo-mechanically processed tools may significantly improve the consistency of the metalworking operation over the entire tool service life in comparison with conventional punches.

As is apparent from FIGS. 13A-C, the edge of the conventional M2-grade tool steel punch (shown in the electron micrograph of FIG. 13B) experienced severe adhesive and abrasive wear typical in the metal-forming application, while the edge of the processed M2 tool (shown in the electron micrograph of FIG. 13C) experienced minor abrasive wear by comparison. The punches were evaluated at end of the service life of each respective tool.

These improvements in tool life and wear resistance result from realignment of the carbide and/or alloy bands in a direction other than the primary loading direction, which is aligned generally with the centerline or longitudinal axis of a punch, and potential minor contributions from secondary mechanisms. The re-alignment of carbide and/or alloy bands significantly reduces the probability of failure along the working edge, while improving tool life, edge retention, and wear resistance. Improvements in tool life and wear resistance may also result from an increase in density of the interband spacing in the processed section.

EXAMPLE 5

A conical blank or preform was prepared with a geometry as shown in FIG. 4A. The blank had an overall length of about 5.3 inches and a diameter of about 0.76 inches. The tip had a length dimension of about 0.74 inches with an included angle of about 24° such that the tip tapered to a blunt end having a diameter of about 0.105 inches. The conical blank was composed of a hot-rolled powder metal M4-type tool steel. The tip of the conical blank was thermo-mechanically processed using a single hot-upsetting type of thermo-mechanical process as described above in Example 1. The preform was formed into a broach with the working end containing the thermo-mechanically processed material. The construction of the broach is shown in FIG. 15A with the cross-sectional configuration shown in FIG. 15B. The broach was used to make 0.883 inch diameter spline shapes in workpieces comprising cold drawn 85,000 psi yield strength steel with the working end contacting the workpieces. Tool life, a conventionally accepted standard for the machining process, was used to benchmark a broach fabricated according to an embodiment described herein against a conventional broach. During use, each broach was held using a whistle notch tool retention mechanism.

Figure 2:
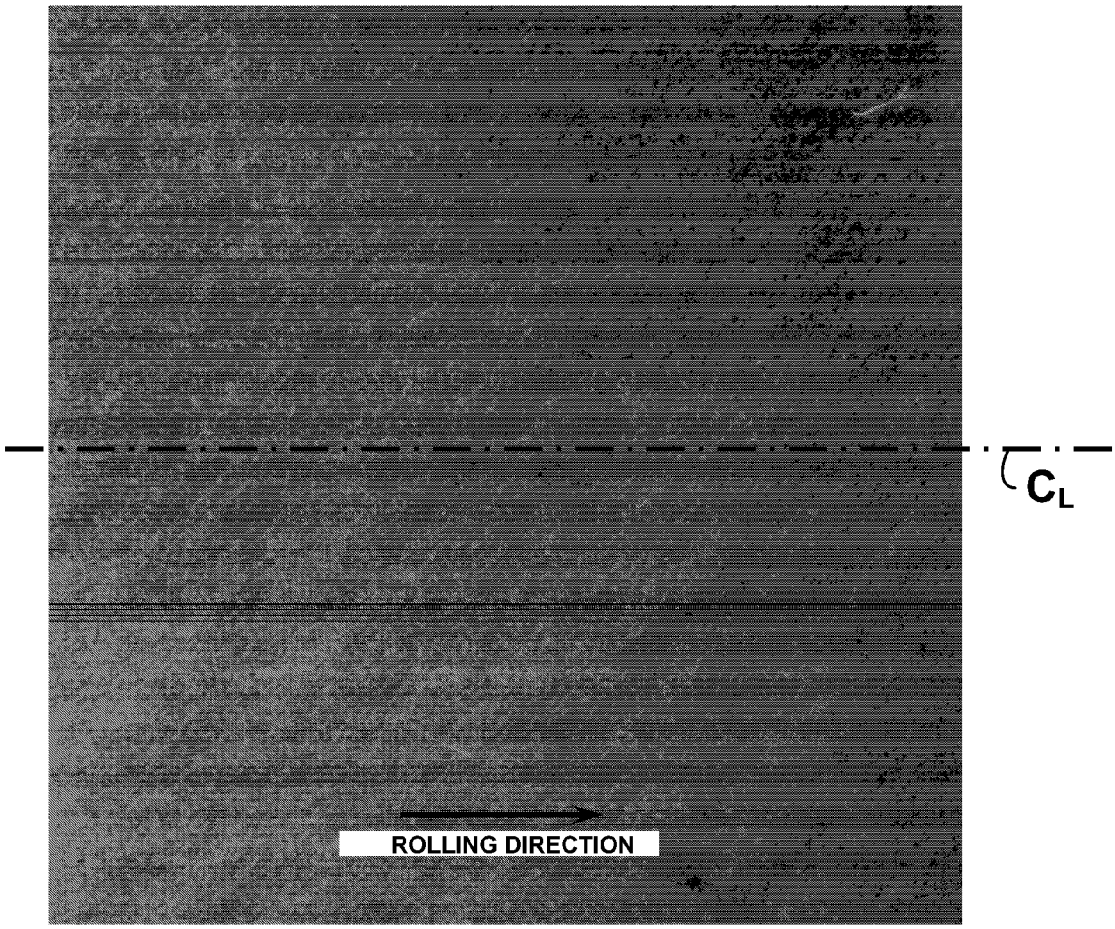
PRIOR ART FIG. 2
FIG. 2 is an optical micrograph similar to FIG. 1 of a powder metallurgical M4 tool steel grade bar stock that also exhibits aligned carbide and/or alloy banding in the rolling direction in accordance with the prior art.

As shown in FIG. 14, the broach with the thermo-mechanically processed working tip (labeled "PM-M4[Single Upset]" and characterized by the modified carbide and/or alloy banding) exhibited an improvement in tool service life of about 1.75 times that of a conventional broach formed from as-rolled M4-grade powder metal tool steel that has aligned carbide and/or alloy bands as shown in FIG. 2. Specifically, the conventional broach lasted for about 2,835 cycles and the thermo-mechanically processed broach lasted for about 4,953 cycles. At the end of their service lives, as is apparent from a comparison of FIG. 15C with FIG. 15E and FIG. 15D with FIG. 15F, the conventional broach also exhibited significantly higher regions of catastrophic failure and poor edge retention in comparison with the broach with the thermo-mechanically processed working tip.

These improvements in service life and wear resistance result from realignment of the carbide and/or alloy bands relative to the hot-rolled condition and potential minor contributions from secondary mechanisms. The re-alignment of the carbide and/or alloy bands significantly reduces the probability of failure along the working edges of the broach, while improving tool life, edge retention, and wear resistance. In a broach, the load is applied at an angle relative to the carbide and/or alloy bands so that the loading direction is not substantially aligned with the carbide and/or alloy bands. Other factors that may improve the service life and wear resistance of the tool include an increase in the density of the interband spacing in the processed section relative to the unprocessed section of the tool.

While the invention has been illustrated by a description of various embodiments and while these embodiments have been described in considerable detail, it is not the intention of the applicants to restrict or in any way limit the scope of the appended claims to such detail. Additional advantages and modifications will readily appear to those skilled in the art. Thus, the invention in its broader aspects is therefore not limited to the specific details, representative apparatus and method, and illustrative example shown and described. Accordingly, departures may be made from such details without departing from the scope of applicants' general inventive concept.

What is claimed is:

1. A method of making a shearing tool for use with a metalworking machine to cut a metal workpiece, the method comprising:

fabricating a tool steel preform having a shank and a tip arranged along a longitudinal axis, the tool steel of the tip having a microstructure with a plurality of carbide bands or a plurality of alloy bands having a first density;

thermo-mechanically processing the tip of the preform to define a first region in the tip such that the carbide bands or the alloy bands in the first region are not unidirectionally aligned and each of the carbide bands or each of the alloy bands in the first region has a positive angle of inclination over a first portion of the first region and a negative angle of inclination over a second portion of the first region, wherein the transition between the positive angle of inclination and the negative angle of inclination is continuous and the distance between the carbide bands or the alloy bands is reduced resulting in a second density greater than the first density, and wherein thermo-mechanically processing includes heating the tip to a processing temperature and, while the tip is at the processing temperature, applying a force to the tip to deform the tip in a direction that is generally parallel to the longitudinal axis to increase an area of a cross-sectional profile of the tip when viewed along the longitudinal axis and wherein, after deforming, the increased area of the cross-sectional profile of the deformed tip does not exceed an area of a cross-sectional profile of the shank when viewed along the longitudinal axis; and finishing the preform into the shearing tool with the first region of the tip defining a cutting edge at the intersection of a working surface for contacting the metal workpiece and a sidewall of the shearing tool, wherein the processing temperature is above the lower transformation temperature of the tool steel.

2. The method of claim 1 wherein fabricating the preform further comprises:

forming the tip of the preform with a cross-sectional profile viewed along the longitudinal axis that is smaller in area than a cross-sectional profile of the shank.

3. The method of claim 2 wherein forming the tip of the preform includes forming the tip to have a frustoconical or bullet shape with an included angle, and thermo-mechanically processing the tip further comprises:

increasing the included angle of the tip when the tip is thermo-mechanically processed.

4. The method of claim 1 wherein the tip of the preform is thermo-mechanically processed by a forging process.

5. The method of claim 4 wherein the forging process is selected from the group consisting of radial forging, ring rolling, rotary forging, swaging, thixoforming, ausforming, warm/hot upsetting, and combinations thereof.

6. The method of claim 1 wherein the carbide bands or the alloy bands in the tip of the tool steel preform are substantially aligned with the longitudinal axis of the tip before the tip is thermo-mechanically processed.

7. The method of claim 1 wherein finishing the preform into the shearing tool further comprises:

modifying the shank to include a tool retention structure adapted to be held in position with a tool retention mechanism.

8. The method of claim 1, further comprising:

modifying a shape of the thermo-mechanically processed tip of the preform to reduce an area of the cross-sectional profile of the shaped tip relative to the area of the cross-sectional profile of the thermo-mechanically processed tip; and thermo-mechanically processing the shaped tip with a second thermo-mechanical process to further misalign an orientation of the carbide bands or the alloy bands in the first region relative to the longitudinal axis of the tip, the second thermo-mechanical process increasing the area of the cross-sectional profile relative to the are of the cross-sectional profile of the shaped tip and defining the first region of the shearing tool.

9. The method of claim 8 wherein modifying the shape of the thermo-mechanically processed tip further comprises:

machining the tip of the preform.

10. The method of claim 8 wherein modifying the shape of the thermo-mechanically processed tip further comprises:

forging the tip of the preform.

11. The method of claim 1 wherein the tool steel comprises carbon content within a range from about 0.85 wt. % to about 1.30 wt. %.

12. The method of claim 1 wherein, after increasing the area of the cross-sectional profile of the tip, the cross-sectional profile of the tip is the same as the cross-sectional profile of the shank.

13. The method of claim 1 wherein thermo-mechanically processing the tip further includes deforming the deformed tip in a second direction different from the direction that is generally parallel to the longitudinal axis to reduce the area of the cross-sectional profile of the deformed tip when viewed along the longitudinal axis.

14. The method of claim 13 wherein the second direction includes a direction that is generally perpendicular to the longitudinal axis.

15. The method of claim 13 wherein thermo-mechanically processing the tip further includes deforming the reduced cross-sectional profile deformed tip to increase the area of the cross-sectional profile.

16. The method of claim 15 wherein, after deforming the reduced cross-sectional profile deformed tip, the cross-sectional profile thereof does not exceed the cross-sectional profile of the shank when viewed along the longitudinal axis.

17. The method of claim 1 further comprising: machining the deformed tip, prior to finishing, to reduce the area of the cross-sectional profile of the deformed tip when viewed along the longitudinal axis and then deforming the machined deformed tip to increase the area of the cross-sectional profile thereof when viewed along the longitudinal axis.

18. The method of claim 1 wherein the working surface has a surface normal, and the sidewall is aligned with the surface normal.

19. The method of claim 1 wherein the shearing tool is a punch.

20. A method of making a shearing tool for use with a metalworking machine to cut a metal workpiece, the method comprising:

shaping an end of an existing shearing tool to define a tip arranged along a longitudinal axis with a shank, the tip having a cross-sectional area that is less than the cross-sectional area of the shank and containing a plurality of carbide bands or a plurality of alloy bands having a first density; and thermo-mechanically processing the tip to define a first region in the tip such that the carbide bands or the alloy bands in the first region are not unidirectionally aligned with the longitudinal axis of the tip and each of the carbide bands or each of the alloy bands in the first region has a positive angle of inclination over a first portion of the first region and a negative angle of inclination over a second portion of the first region, wherein the transition between the positive angle of inclination and the negative angle of inclination is continuous and the distance between the carbide bands or the alloy bands is reduced resulting in a second density greater than the first density, and wherein thermo-mechanically processing includes heating the tip to a processing temperature and, while the tip is at the processing temperature, applying a force to deform the tip in a direction that is generally parallel to the longitudinal axis to increase the cross-sectional area of the tip when viewed along the longitudinal axis and wherein, after deforming, the increased cross-sectional area of the tip does not exceed a cross-sectional area of the shank when viewed along the longitudinal axis, the first region of the tip defining a cutting edge at the intersection of a working surface and a sidewall of the shearing tool tool, wherein the processing temperature is above the lower transformation temperature of the tool steel.

21. The method of claim 20 wherein the working surface has a surface normal, and the sidewall is aligned with the surface normal.

22. A method of making a shearing tool for use with a metalworking machine to cut a metal workpiece, the method comprising:

fabricating a tool steel preform having a body of a first geometry and a projecting portion of a second geometry extending from the body, the second geometry being different from the first geometry and having an included angle, the body and the projecting portion arranged along a common axis and having a microstructure with a plurality of carbide bands or a plurality of alloy bands aligned with the common axis;

thermo-mechanically processing the projecting portion to define a first region in the preform such that the carbide bands or the alloy bands in the first region are misaligned relative to the common axis, wherein thermo-mechanically processing includes heating the projecting portion and then applying a force in a direction that deforms the projecting portion toward the body along the common axis and increases the included angle of the second geometry, wherein, after thermos-mechanically processing, shaping the deformed projecting portion to form a second projecting portion of a third geometry extending from the body, the third geometry differing from the first geometry and having a second included angle, the second projecting portion being aligned with the common axis, and thermo-mechanically processing the second protecting portion with a second thermo-mechanical process, the second thermo-mechanical process includes heating the second projecting portion and applying a force that deforms the second projecting portion toward the body along the common axis to increase the second included angle, wherein thermo-mechanically processing the second projecting portion defines the first region, wherein the first region defines a cutting edge at the intersection of a working surface and a sidewall of the shearing tool, the working surface being transverse to the common axis and configured to impact the metal workpiece in a direction aligned with the common axis and the cutting edge being configured to shear the metal workpiece along a line defined by the cutting edge when the metal workpiece is placed in shear by the shearing tool during operation of the metalworking machine.

23. The method of claim 22 wherein during thermo-mechanically processing, the included angle increases to 180° and, after deforming, the working surface is normal to the common axis.

24. The method of claim 22 wherein thermo-mechanically processing the projecting portion includes deforming the second geometry to match a cross-section of the first geometry.

25. The method of claim 22 wherein the shearing tool is a punch, the body of the tool steel preform includes a shank, and the projecting portion includes a tip arranged along the common axis from the shank and wherein thermo-mechanically processing the projecting portion includes deforming the tip.

26. The method of claim 22 wherein shaping includes machining the deformed projecting portion.

27. The method of claim 22 wherein shaping includes forging the deformed projecting portion.

28. A method of making a shearing tool for use with a metalworking machine to cut a metal workpiece, the method comprising:

shaping an end of an existing shearing tool to define a tip arranged along a longitudinal axis with a shank, the tip having a cross-sectional area that is less than the cross-sectional area of the shank and containing a plurality of carbide bands or a plurality of alloy bands having a first density; and thermo-mechanically processing the tip to define a first region in the tip such that the carbide bands or the alloy bands in the first region are not unidirectionally aligned with the longitudinal axis of the tip and each of the carbide bands or each of the alloy bands in the first region has a positive angle of inclination over a first portion of the first region and a negative angle of inclination over a second portion of the first region, wherein the transition between the positive angle of inclination and the negative angle of inclination is continuous and the distance between the carbide bands or the alloy bands is reduced resulting in a second density greater than the first density, and wherein thermo-mechanically processing includes heating the tip to a processing temperature and, while the tip is at the processing temperature, applying a force to deform the tip in a direction that is generally parallel to the longitudinal axis to increase the cross-sectional area of the tip when viewed along the longitudinal axis and wherein, after deforming, the increased cross-sectional area of the tip does not exceed a cross-sectional area of the shank when viewed along the longitudinal axis, the first region of the tip defining a cutting edge at the intersection of a working surface and a sidewall of the shearing tool;

modifying a shape of the thermo-mechanically processed tip to reduce an area of the cross-sectional profile of the shaped tip relative to the area of the cross-sectional profile of the thermo-mechanically processed tip; and thermo-mechanically processing the shaped tip with a second thermo-mechanical process to further misalign an orientation of the carbide bands or the alloy bands in the first region relative to the longitudinal axis of the tip, the second thermo-mechanical process increasing the area of the cross-sectional profile relative to the area of the cross-sectional profile of the shaped tip and defining the first region of the shearing tool.

29. The method of claim 28 wherein modifying the shape of the thermo-mechanically processed tip further comprises: machining the tip of the preform.

* * * * *